166-66 SR
10/5/82 XR 4,352,376

United States Patent [19]

Norwood

[11] 4,352,376

[45] Oct. 5, 1982

[54] CONTROLLER FOR WELL INSTALLATIONS

[75] Inventor: William L. Norwood, Columbus, Ohio

[73] Assignee: Logic Controls Corp., Converse, Tex.

[21] Appl. No.: 216,781

[22] Filed: Dec. 15, 1980

[51] Int. Cl.[3] ..... F21B 34/16

[52] U.S. Cl. ..... 137/624.15; 137/552.7; 137/624.2; 166/53; 166/64; 166/66

[58] Field of Search ..... 137/552.7, 624.15, 624.2; 166/53, 64, 66

[56] References Cited

U.S. PATENT DOCUMENTS

| | | | |
|---|---|---|---|
| 3,377,532 | 4/1968 | Lane et al. | 317/262 |
| 3,445,746 | 11/1969 | Delatorre | 320/40 |
| 3,670,209 | 6/1972 | Hensen | 317/135 R |
| 3,787,729 | 1/1974 | Bennett | 307/41 |
| 3,876,950 | 4/1975 | O'Connor | 328/130 |
| 3,989,374 | 11/1976 | Latka et al. | 355/69 |
| 4,012,673 | 3/1977 | Saarem et al. | 361/196 |
| 4,061,927 | 12/1977 | Link | 307/41 |
| 4,150,721 | 4/1979 | Norwood | 166/53 |
| 4,165,532 | 8/1979 | Kendall et al. | 137/624.2 X |
| 4,215,746 | 8/1980 | Hallden et al. | 166/53 |
| 4,244,022 | 1/1981 | Kendall | 137/624.2 X |
| 4,304,989 | 12/1981 | Vos et al. | 137/624.2 X |

*Primary Examiner*—Gerald A. Michalsky
*Attorney, Agent, or Firm*—Mueller and Smith

[57] ABSTRACT

A controller for well installations which responds to external signals originating from system monitors. This response may be modified by operator inserted delays or may be utilized to carry out a SET function wherein all signals are rejected until an externally derived RESET signal is received. A priority protocol is provided with respect to the SET and RESET functions. The circuit of the controller is housed within a circuit housing which includes a polymeric seal and operates in conjunction with a sealed keypad. This circuit housing is incorporated within a principal housing and a positive pressure is maintained within that principal housing to assure the integrity thereof.

45 Claims, 27 Drawing Figures

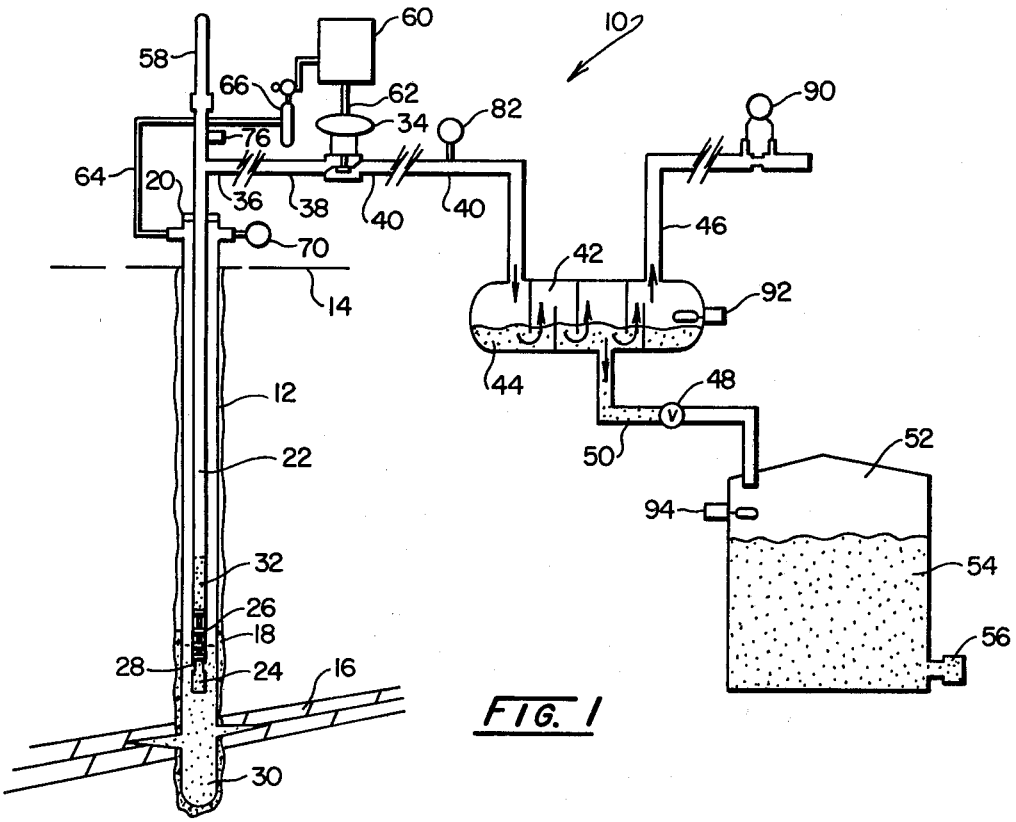
FIG. 1
FIG. 2
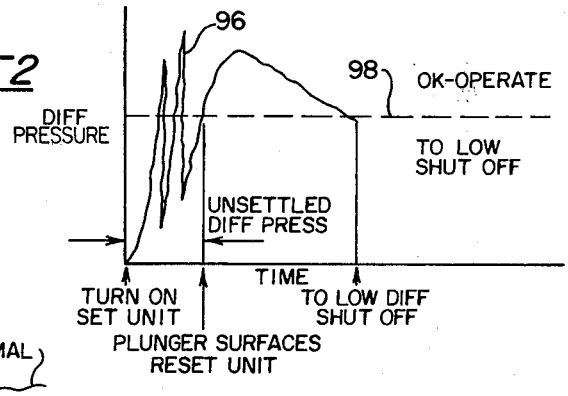
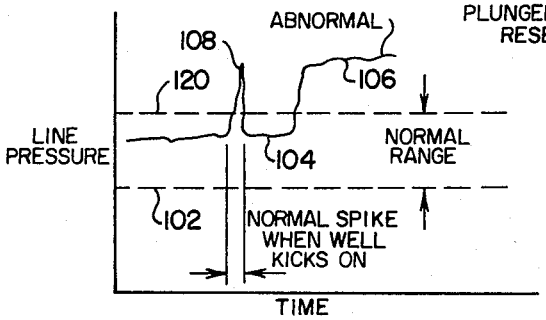
FIG. 3

350
351
352
353
354
356
358
360
362
364
366
368
370
372
374
376
378
380
ROM
RAM
FROM FIG. 7B
+Vcc
+VBAT
MA2
MA3
MAØ
MA1
>CL
MRD
MWR
CE1
CE3
A8
CEZ
CSØ
CS1
CS2
CS3
CS
AØ
A1
A2
A3
A4
A5
A6
A7
DØ
D1
D2
D3
D4
D5
D6
D7

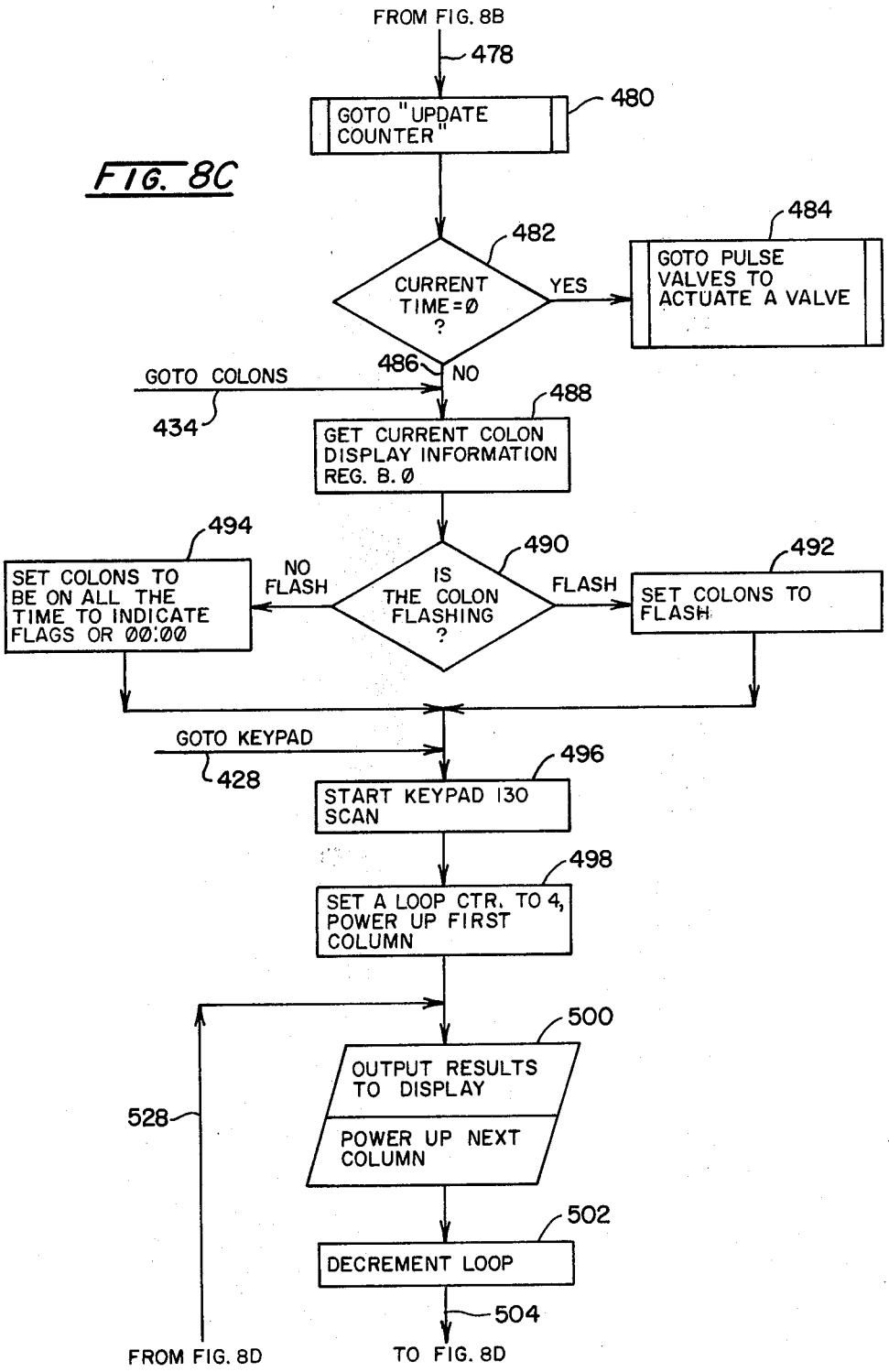
FROM FIG. 8B
478
GOTO "UPDATE COUNTER"
480
FIG. 8C
482
CURRENT TIME=Ø ?
YES
484
GOTO PULSE VALVES TO ACTUATE A VALVE
486
NO
GOTO COLONS
434
488
GET CURRENT COLON DISPLAY INFORMATION REG. B. Ø
494
SET COLONS TO BE ON ALL THE TIME TO INDICATE FLAGS OR ØØ:ØØ
NO FLASH
490
IS THE COLON FLASHING ?
FLASH
492
SET COLONS TO FLASH
GOTO KEYPAD
428
496
START KEYPAD 130 SCAN
498
SET A LOOP CTR. TO 4, POWER UP FIRST COLUMN
500
OUTPUT RESULTS TO DISPLAY
POWER UP NEXT COLUMN
528
502
DECREMENT LOOP
504
FROM FIG. 8D
TO FIG. 8D

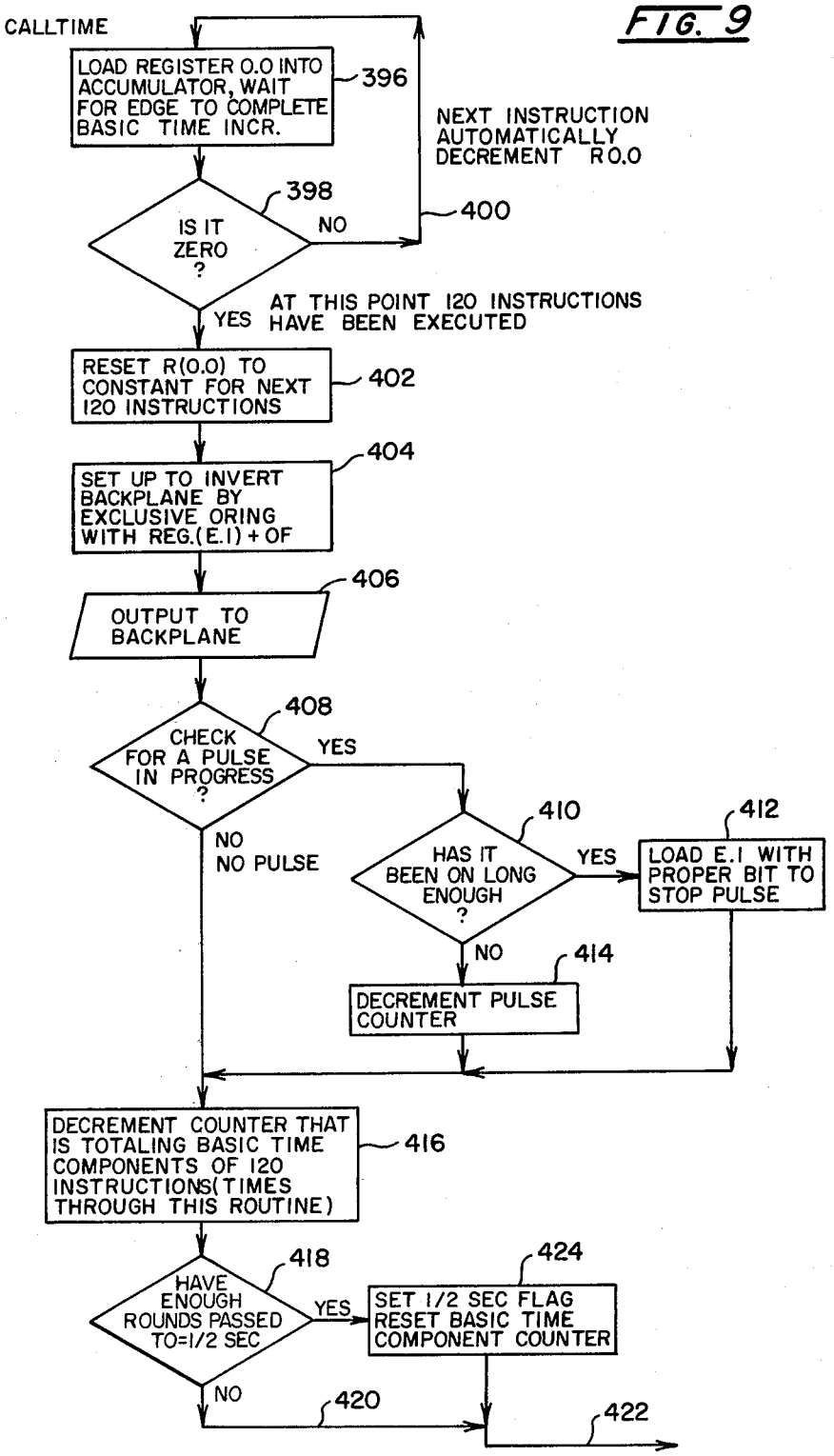
FIG. 9
CALLTIME
LOAD REGISTER 0.0 INTO ACCUMULATOR, WAIT FOR EDGE TO COMPLETE BASIC TIME INCR.
396
NEXT INSTRUCTION AUTOMATICALLY DECREMENT R0.0
398
IS IT ZERO ?
NO
400
YES
AT THIS POINT 120 INSTRUCTIONS HAVE BEEN EXECUTED
RESET R(0.0) TO CONSTANT FOR NEXT 120 INSTRUCTIONS
402
SET UP TO INVERT BACKPLANE BY EXCLUSIVE ORING WITH REG.(E.1) + OF
404
OUTPUT TO BACKPLANE
406
CHECK FOR A PULSE IN PROGRESS ?
408
YES
NO
NO PULSE
HAS IT BEEN ON LONG ENOUGH ?
410
YES
LOAD E.1 WITH PROPER BIT TO STOP PULSE
412
NO
DECREMENT PULSE COUNTER
414
DECREMENT COUNTER THAT IS TOTALING BASIC TIME COMPONENTS OF 120 INSTRUCTIONS(TIMES THROUGH THIS ROUTINE)
416
HAVE ENOUGH ROUNDS PASSED TO=1/2 SEC
418
YES
SET 1/2 SEC FLAG RESET BASIC TIME COMPONENT COUNTER
424
NO
420
422

EXTERNAL FLAGS

GOTO "CALLTIME"
590
532
592
SET MULTIPLEXER 166 FOR ACCEPTING EXTERNAL SIGNAL
594
SCAN OFF FLAG
IT'S THERE
596
INCREMENT REG. 3.0
INCREMENT REG. 3.0
ON/OFF FLAG REGISTER
NOT THERE
598
SCAN ON FLAG
NO THERE
IT'S THERE
600
INCREMENT REG. 3
INITIALIZE R(4.0) FOR SET/RESET
602
603
SCAN SET FLAG
NOT THERE
604
INCREMENT REG. 4
INCREMENT REG. 4
IT'S THERE
606
SCAN RESET FLAG
IT'S THERE
608
INCREMENT REG. 4
NOT THERE
610
TO FIG. 10B

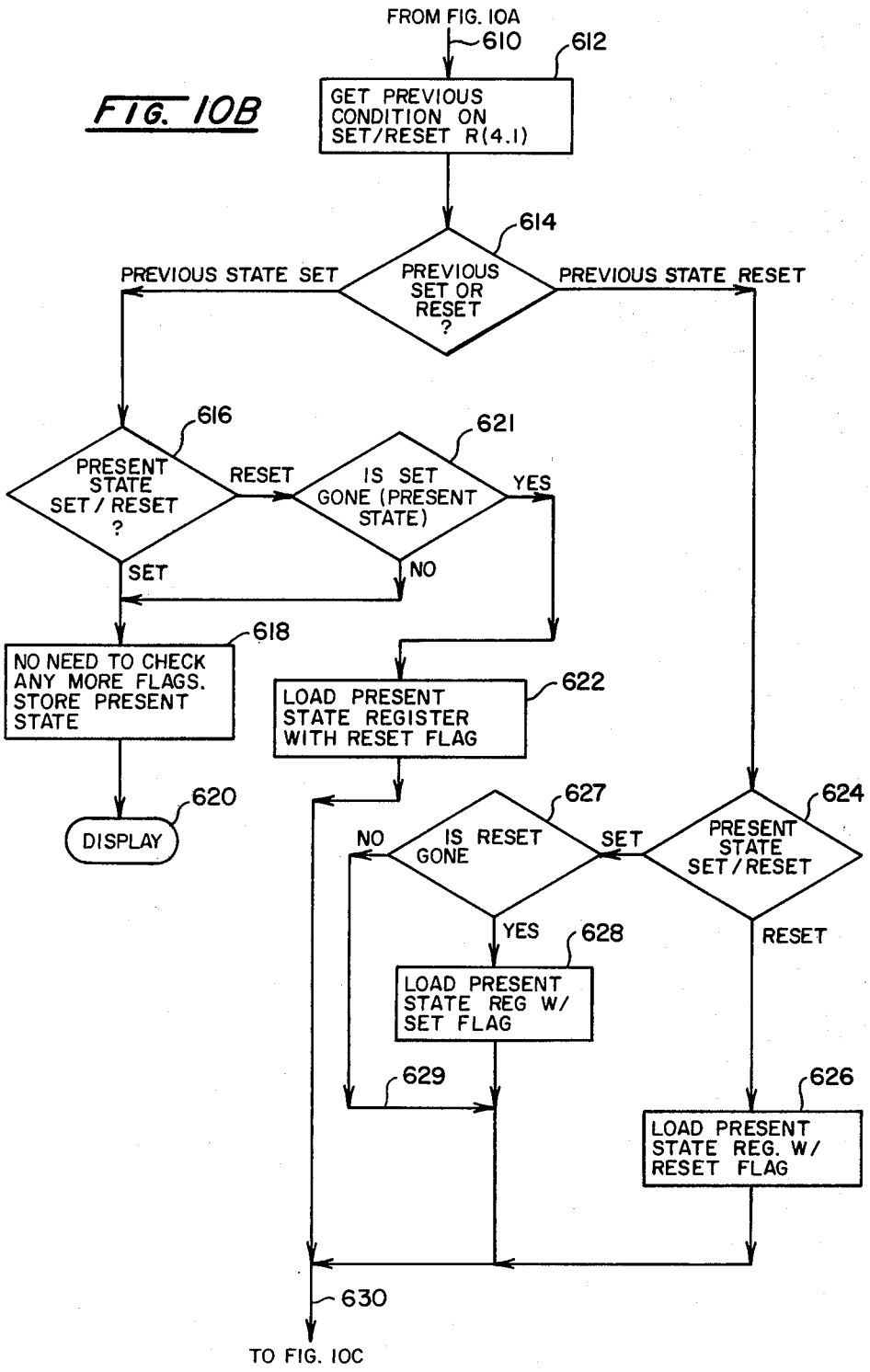
FIG. 10B
FROM FIG. 10A
610
612
GET PREVIOUS CONDITION ON SET/RESET R(4.1)
614
PREVIOUS SET OR RESET ?
PREVIOUS STATE SET
PREVIOUS STATE RESET
616
PRESENT STATE SET / RESET ?
RESET
621
IS SET GONE (PRESENT STATE)
YES
SET
NO
618
NO NEED TO CHECK ANY MORE FLAGS. STORE PRESENT STATE
622
LOAD PRESENT STATE REGISTER WITH RESET FLAG
620
DISPLAY
627
IS RESET GONE
NO
SET
624
PRESENT STATE SET / RESET
YES
628
RESET
LOAD PRESENT STATE REG W/ SET FLAG
629
626
LOAD PRESENT STATE REG. W/ RESET FLAG
630
TO FIG. 10C

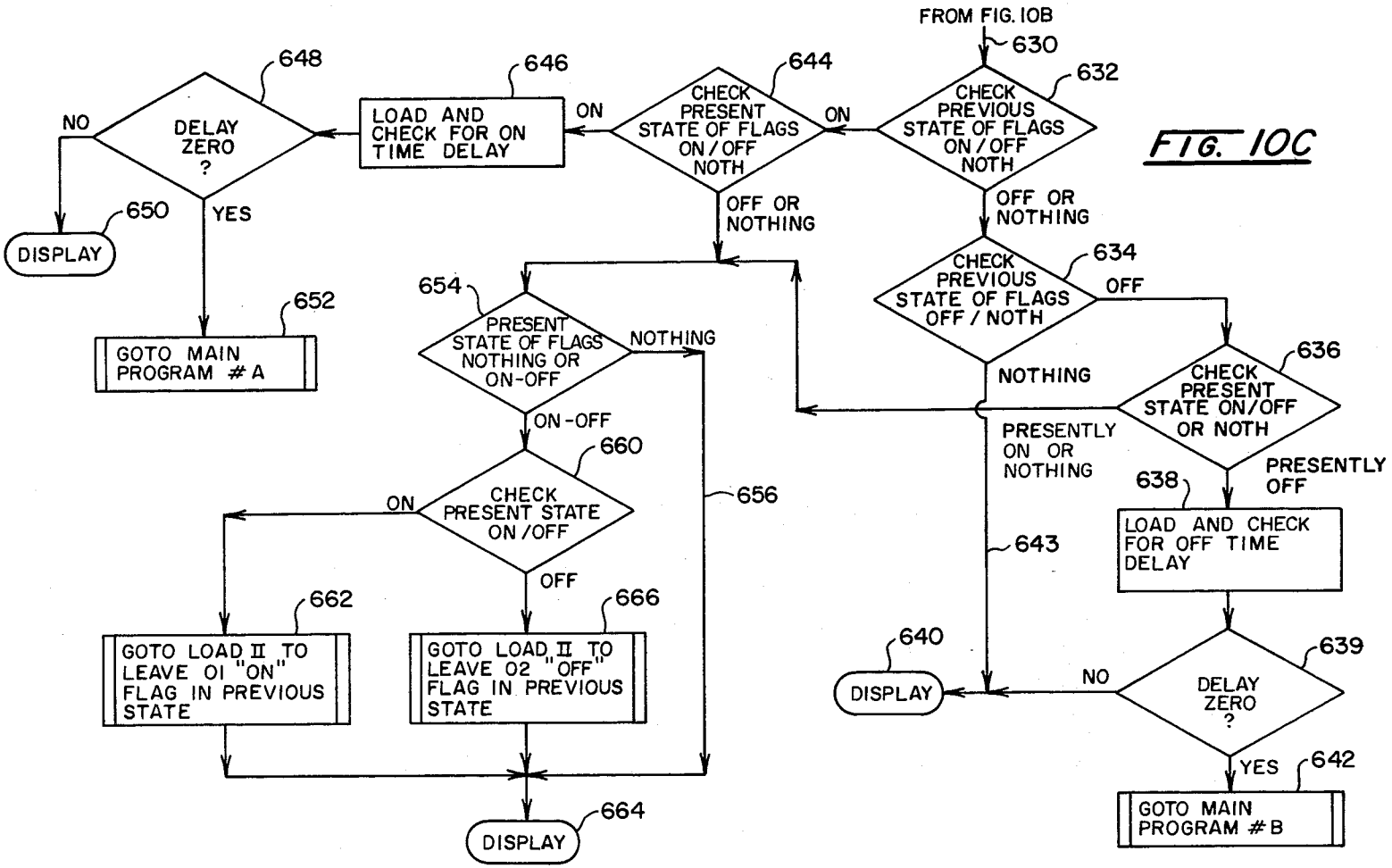
FIG. 10C
FROM FIG. 10B
630
632
CHECK PREVIOUS STATE OF FLAGS ON/OFF NOTH
OFF OR NOTHING
634
CHECK PREVIOUS STATE OF FLAGS OFF / NOTH
OFF
NOTHING
636
CHECK PRESENT STATE ON/OFF OR NOTH
PRESENTLY OFF
PRESENTLY ON OR NOTHING
638
LOAD AND CHECK FOR OFF TIME DELAY
639
DELAY ZERO ?
YES
NO
642
GOTO MAIN PROGRAM #B
643
640
DISPLAY
644
CHECK PRESENT STATE OF FLAGS ON/OFF NOTH
ON
OFF OR NOTHING
646
LOAD AND CHECK FOR ON TIME DELAY
648
DELAY ZERO ?
YES
NO
650
DISPLAY
652
GOTO MAIN PROGRAM # A
654
PRESENT STATE OF FLAGS NOTHING OR ON-OFF
NOTHING
ON-OFF
656
660
CHECK PRESENT STATE ON/OFF
OFF
ON
662
GOTO LOAD II TO LEAVE 01 "ON" FLAG IN PREVIOUS STATE
666
GOTO LOAD II TO LEAVE 02 "OFF" FLAG IN PREVIOUS STATE
664
DISPLAY

CONTROLLER FOR WELL INSTALLATIONS

BACKGROUND OF THE INVENTION

The technology involved in the production of crude petroleum and natural gas encompasses a broad range of techniques and procedures. Important among these are the non-pumping approach or "gas lifting" techniques of production wherein, generally, the wells are operated on an intermittent basis by the utilization of some form of cyclical treatment. With this arrangement, natural gas pressures, whether artificially or naturally induced, are selectively permitted to build at the well bottom until conditions therewithin are such that liquid accumulated within the well, which usually will include oil and salt water, will be expelled by the pressure of the natural gas into separation and collection facilities.

Concerning wells intended principally for natural gas production, rarely occurring is the "dry" natural gas well wherein substantially no liquid hydrocarbons or water are encountered in the course of production. Commonly, such liquids will accumulate in the well to an extent wherein the energy extant in and available from the natural gas production reservoir of the pertinent geologic region is inadequate to permit continuing gas flow. Without correction, the static pressure associated with such fluids eventually may cause a well failure typically termed "loading up." To avoid excessive amounts of this liquid buildup, in the past, a procedure then termed "intermitting" was carried out wherein mechanical clock controllers operating in a limited but repeating time cycle, periodically vented a well to the atmosphere to effect an expulsion of the liquid. Venting to the atmosphere now is considered to be an economically unacceptable procedure. However, the term "intermitting" has been applied to a gas well production procedure wherein the well is produced on a cyclical basis. In this regard, in many geologic areas, for example, in the Appalachian region as well as regions in the Fort Worth basin, gas well production must be cycled in a highly accurate manner. This cyclical treatment involves a "shutting-in" procedure wherein the well is closed for a carefully determined interval of time adequate to allow well pressure to build up sufficiently to expell all fluids upons subsequent opening up. Production only occurs during that relatively short interval wherein fluid and gas are expelled into a sales line system. Then the well again is "shut in" to achieve necessary pressure buildup. As is apparent, the timing of these operations is critical. For example, a typical well may produce for a twenty minute interval following which it must be "shut in" for an interval of four hours. Because the duty cycle of the well is so short, deriving an optimum formula for producing it becomes a taxing endeavor. Many production parameters are considered, no two wells exhibiting the same performance signature, and the performance signature of any given well changing with the age thereof. In many applications, a failure to shut in a well within mere minutes of the proper time envelope of production may result in a complete "loading up" of the well. This represents a failure which may be quite expensive to correct.

Many wells within the noted geologic regions and others serve to produce both natural gas and liquid petroleum in the course of their cyclically controlled operation. Very often to improve their production capabilities, the tubing strings in such wells incorporate a plunger lift device. With this arrangement, when the well is "shut in," the plunger is situate in the lowermost portion of the tubing string. As natural gas pressure develops within the well during the "shut in" interval, a "slug" of liquid accumulates in the tubing string above the plunger. At an optimum point in time, a motor valve coupled between the tubing string and separation and collection equipment is opened to permit the plunger to be propelled to the surface at the wellhead, and fluid and gas which has collected within the string is delivered to appropriate receiving facilites. For example, through the use of separation stages, the liquid petroleum is segregated from the gas and salt water; and the gas cap, for the production interval, is recovered.

For a considerable period of time and including the present day, control over the cyclical production of wells has been one based simply upon a crude hand wound clock-operated device, the cyclical closing and opening of a motor valve being determined by the operator following the periodic monitoring of a variety of parameters such as differential pressure between casing and tubing string, sales line pressure, experience with adjacent wells and the like. With such monitoring, the signature of the well, i.e. the periodic development of pressure differentials optimum for producing and shutting in have been determined and the clock controls were adjusted accordingly. Such periodic operation of the wells was found to be inadequate for a variety of conditions including the difficulties associated with finding reliable operational personnel to periodically visit the wellhead sites and adjust the controlling devices properly. Where such operational maintenance failed, a loading-up condition often was encountered requiring expensive swabbing procedures and the like to clear the tubing.

More recently, a gas well controller system operating upon an electronic basis has been introduced with considerable success to the industry. Described in U.S. Pat. No. 4,150,721 by W. L. Norwood, the electronic controller provided for long-term, battery-operated control over wells and which simplified the control adjustment procedure as required of operators. Of particular importance, the controller responds to system parameters to override the cycle timing provided thereby, conditions often being encountered where the cyclical timing system should be overridden and subsequently reinitiated on an automatic basis. For example, should the tubing pressure at the wellhead fall to a certain predetermined level, an indication may be present that gas is not finding its way through the tubing string and that liquid is building up. Accordingly, such a situation may present an overriding condition calling for shutting in the well. Other conditions may relate to the safe operation of a gas production system. For example, excessive liquid levels in separating systems will call upon an overriding of well cycling as will line pressure fluctuation which can have a particularly deleterious affect upon the production of a well.

Considering wells which function principally to produce liquid petroleum products, an often encountered non-pumping form of production technique involves what is termed as "injection gas lift." With this technique, natural gas from a well or source other than the well being produced is pumped under compression to the lower regions of the well, again on an intermittent basis. The comingling of gas with fluid within the well, for many applications, considerably enhances production output. As before, however, the introduction of such compressed gas into the well should be carried out on a highly accurate basis, such accuracy preferably being to the extent of numbers of seconds. Conventional controllers otherwise used to drive motor valves and the like, may be utilized for the purpose of controlling gas injection systems, however, to the present, the accuracy of control desired has not been met nor has the development of control systems which accommodate to a variety of environmental factors been evolved.

A broad variety of gas and oil well production difficulties have been found to persist in the industry even following the advances achieved with the noted electronic controller system. The inventor named herein has isolated numerous of the operational difficulties which occur notwithstanding the introduction of controller devices which are capable of responding to externally switched phenomena, for example, associated with separator liquid levels, sales line pressures, differential pressures at wellheads, collector tank levels, and the like. Due to the great variety of operational situations which can occur and are heueristically accommodated, a need has developed for a controller system and technique which remains practical in terms of cost while having the flexibility of accommodating a large range of required operational sequences, values, or parameters, each of which may vary in the course of a production cycle.

Another aspect of the controller requirements for fluid hydrocarbon production looks to both the human engineering requirements in view of the level of confidence and competence one may repose in typical operator personnel, as well as the environments encountered in oil production regions. In the latter regard, the controllers are required to operate in environments ranging from desert to mountain to off-shore coastal facilities.

While electronic controller systems enjoy an expanded performance capability for improving production, electronic components and associated wiring are prone to attack by the corrosive environments within which they are called upon to operate. Solder and wiring are subjected to corrosion which, particularly in off-shore installations, is quite severe. Additionally, for the latter form of installation, the weather environments are severe to the extent that the controllers are subjected to submersion and high wind forces occasioned from hurricane conditions and the like. Thus, the controllers are subjected to weather and operationally induced dynamic forces as well as atmospheric environment attacks. Another aspect in providing adequate protection for the controllers resides in the simple failure of many operators to close up and seal containment boxes following their routine adjustment and inspection. In consequence, the controllers must be removed for factory servicing on a schedule which is undesirably accelerated.

SUMMARY OF THE INVENTION

The present invention is addressed to an improved controller and control system for use in carrying out the operation of well installations. The controller exhibits an operational flexibility permitting its successful utilization in conjunction with a broad variety of unique control requirements. This operational flexibility, providing for the accommodation of a large range of required operational sequences of values or parameters, is achieved, however, at acceptable cost levels. The controller of the invention further is capable of sustained operation within severe environments, for instance, including those encountered in off-shore production facilities. Additionally, the controller accommodates to many human engineering requirements such that situations wherein container doors are left open and the like do not represent conditions under which controller damage may be experienced. This advantage is obtained, in part, through the elimination of mechanical switches of conventional variety, a sealed keypad arrangement being utilized in conjunction with a control circuit incorporating a microprocessor.

As another feature and object of the invention, the noted microprocessor, the use of which permits operational flexibility as well as the elimination of switches, is structured so as to be capable of operating for extended periods of time utilizing a conventional D battery power source. This is achieved through a unique timing system permitting the microprocessor to operate at a relatively slow frequency.

Another object of the invention is to provide a controller for use in conjunction with the control of well installations which includes a display arrangement selectively energizable to provide visible digital characters representative of select components of time as well as a manual input arrangement including an array of keys each being actuable to have a numeric output condition representing a discrete one of a decade of numbers. The controller includes an oscillator which is energizable to provide a clock output at a frequency selected to minimize the power requirement of the device. Additionally, a terminal input is provided which is connectable with switches external to the controller for receiving external signals resulting from operational parameter monitoring. Because such signals may have a very short duration and in view of the relatively low clock frequency of the controller, a detection arrangement having an output of select duration in response to a received external signal is provided. The controller includes a processor including memory of selectively retaining time interval data representing the numeric output conditions of the manual input at addressable locations. The processor is responsive to the clock output of the oscillator for carrying out time interval definition in correspondence with addressed time interval data to derive actuation signals at the timed limit of a defined time interval. The processor further is responsive to the detected outputs of select duration for generating actuation signals to operate a motor valve or the like and is responsive to clock outputs for deriving time increment outputs energizing the display to show a lapsed time within a given control interval. The controller additionally includes a valve which is responsible to the actuation signals to derive control inputs serving to operate the noted motor valve.

Another feature and object of the invention presides in the provision of a controller wherein the manual input to a keypad includes utilization of keys actuable both to provide numeric output conditions and to provide function output conditions. These function output conditions include both commands to cause the immediate development of an "on" or "off" state and also the provision of selective delays in conjunction with the responses to derive external monitoring signals. With the invention, the operator may select time intervals with which to cause the controller to respond to an external signal representing a state transition. To provide this, the processor circuit of the controller includes memory for retaining delay interval data and is responsive to a function output condition representing a delay insertion to energize the display of the controller to show characters representing memory retained time interval data for delay purposes. By actuating numerical keys within a predetermined interval following the actuation of a delay function key, the memory retained delay interval data may be altered in accordance with the desires of the operator. To simplify utilization of the controller, function keys providing for the display of "on" and "off" states of a well also are provided, actuation of such keys providing for immediate display at the controller of the amount of time set into the system for closing in a well as well as producing a well. By actuating numeric keys within a predetermined interval following the actuation of the display or function keys, the operator is provided a simple technique for entering new time cycles.

As another feature and object of the invention, the controller is provided which incorporates SET and RESET terminals responsive to externally derived monitoring signals. These SET and RESET features operate to accept or reject state change or "on" and "off" externally derived signals to provide a considerably enhanced flexibility of control over well installations. In this regard, the control circuit of the controller of the invention is responsive to the manual input at a keypad for deriving actuation signals defining selectively timed "on" and "off" states for a valve as responsive to external signals received as a state change input in the absence of an external signal received as a SET input for deriving such an actuation signal. The control circuit is responsive to an external signal received as a state change input subsequent to the receipt of an external signal of limited duration received as a SET input and the receipt of an external signal received as a RESET input subsequent to the SET input reception where either of the SET or RESET external signal inputs are received initially in a continuous fashion as opposed to an intermittent one, then that signal will prevail over any subsequently received and otherwise countermanding signal. In this regard, a continuous SET signal will prevail over a subsequent RESET signal input, while a continuous and initial RESET input will prevail over a subsequent SET signal input.

As another feature and object of the invention, the controller is provided which comprises a principal housing having an enclosable cavity portion formed inwardly of a continuous, peripherally disposed ledge. A controller circuit mounted upon a circuit board and having a visual display mounted at a predetermined position thereon is mounted with a circuit housing having a sealing cavity portion which supports the circuit board and which is formed having an opening for providing visual access to the visual display. A polymeric sealing material is positioned within the circuit housing cavity portion surrounding the circuit board in sealing relationship with the exception of the noted display. This circuit housing is removably attached in abutting engagement with the peripheral housing ledge to effect the enclosure of the noted cavity and a seal is provided intermediate the principal housing ledge and the circuit housing. Thus, an initial, weather-proof structure is provided. Mechanical switches and the like are avoided through the use of a sealed keypad mounted upon the outwardly disposed surface of the circuit housing. The multilead bus from this keypad extends through the sealing material to the sealed circuit again to assure immunity of controller electronics from weather conditions. As another aspect of the invention, the cavity of the principal housing of the controller includes an arrangement for introducing a non-corrosive hydrocarbon gas such as natural gas into the housing cavity to derive a positive pressure therewithin to assure that no corrosive external environmental atmosphere may encroach within the cavity of the controller. By utilizing a gas driven valve which is actuated intermittently as part of the controller scheme, the pressurization is carried out intermittently such that by the utilization of a check valve at the lowermost portion of the cavity of the housing, a self-purging of any liquids which may have developed within the cavity is provided.

Other objects of the invention will, in part, be obvious and will, in part, appear hereinafter. The invention, accordingly, comprises the system and apparatus possessing the construction, combination of elements and arrangement of parts which are exemplified in the following detailed description.

For a fuller understanding of the nature and objects of the invention, reference should be had to the following detailed description taken in connection with the accompanying drawings.

BRIEF DESCRIPTION OF THE DRAWINGS

FIG. 1 is a sectional schematic view of a well installation with components shown sectionally and out of scale;

FIG. 2 is a non-scale draft showing differential pressure responses representing well production conditions which may be encountered;

FIG. 3 is a non-scale graph showing line pressure conditions which may be encountered in well production;

FIGS. 8A–8E, when combined, provide a flow diagrammatic representation of the main program microinstructions of the controller circuit of the invention;

FIG. 9 is a flow diagram of the CALLTIME subroutine of the microinstructions of the controller circuit of the invention;

FIGS. 10A–10C, when combined, provide a flow diagram of the EXTERNAL FLAGS subroutine of the microinstructions of the controller circuit of the invention;

DETAILED DESCRIPTION

Figure 4:
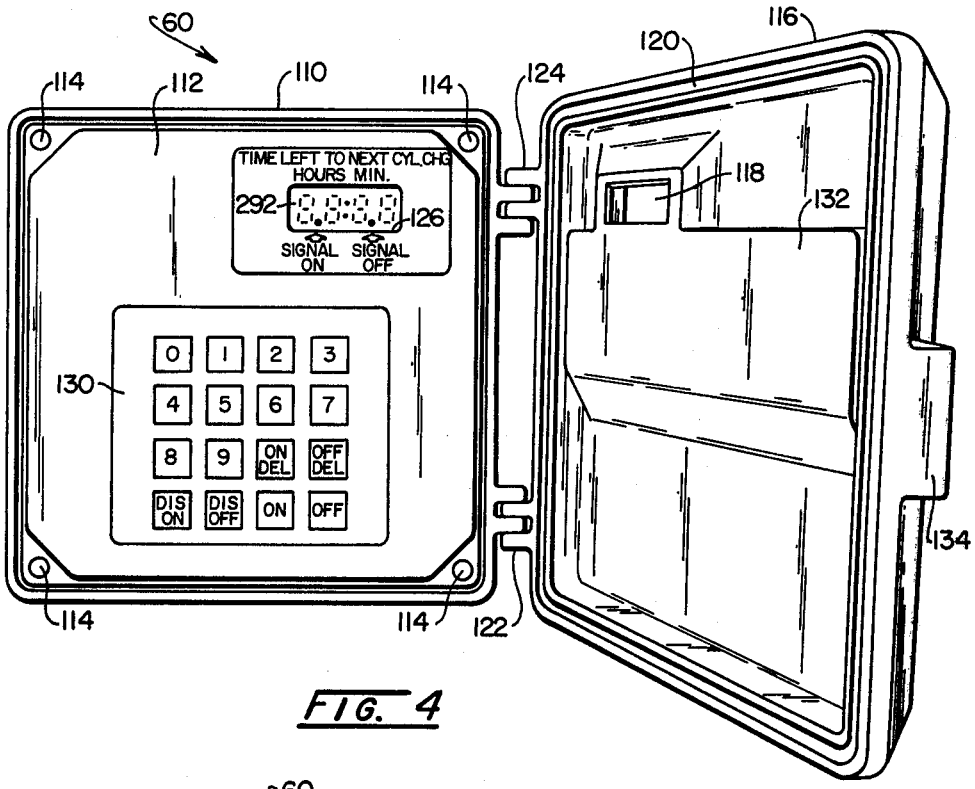
FIG. 4 is a pictorial representation of the front portion of a controller according to the invention.

The well production of fluid hydrocarbons involves, inter alia, the variable performance parameters of tubing string pressures, wellhead pressures, sales line differential pressures representing flow, location of operational components within the tubing string, liquid levels within separator and storage implements, tubing or piping distances and the like. For any given well installation, a unique "signature" will be evolved over a period of operation which well may call into play the above parameters as well as others as, for example, may be encountered in conjunction with injection forms of gas lift procedures. To gain an insight into the production requirements for a well installation, a schematic representation of a typical natural gas-oil production facility is portrayed in conjunction with FIG. 1. Referring to that Figure, a well installation as might be found, for example, in the mid-western region of the United States, is revealed generally at 10. Well 10 includes an elongate casing 12 which extends through the terrestrial surface 14 to a strata 16. Strata 16 is present as porous rock over which an impervious cap is located. The resultant formation serves as a form of pressurized reservoir for oil, gas, water and the like. While the techniques for penetrating strata 16 with casing 12 vary from one installation to another, generally, the outer surface of the casing is sealed with conventional cementing procedures, this seal being represented at 18. Access to the strata or formation 16 following the placement of seal 18 may be provided utilizing a variety of techniques, for instance, controlled explosions or the like. Surface control over the well is maintained by a wellhead 20 extending above surface 14. Head 20 incorporates appropriate hangars and seals which serve to support a tubing string 22 which extends from the vicinity of wellhead 20 to an open lower end 24 situate in the vicinity of the lower level of casing 12. In some installations, a plurality of tubing strings 22 are utilized, each extending to a predetermined geologic formation to evolve production at that location. The Figure further reveals the presence of a plunger or "rabbit" 26 near opening 24. This device is prevented from moving through the opening 24 by a constriction 28. With the plunger lift arrangement, well installation 10 is operated on a cyclical basis, being "shut in" for an interval during which gas pressure gradually elevates within casing 12. Additionally, liquid generally comprising oil and salt water, as at 30, accumulates within casing 12 which gradually migrates through tubing string 22 above plunger 26 as is represented at 32. Such an accumulation is typically referred to as a "slug" of fluid.

When operating under normal control procedures, at a time appropriate wherein the pressure of gas within casing 12 has developed sufficiently for opening it for a predetermined period of time, a motor valve, as shown schematically at 34, is caused to open which, in turn, permits plunger 26 to be propelled from the lower end of tubing string 22 under the influence of the accumulated gas pressure. As this occurs, the slug of liquid and gas above plunger 26 moves through a horizontal T connection 36, conduit 38, and valve 34 to be directed into conduit 40. The initial surge of gas followed by fluid passes through conduit 40 and into the input of a separator 42. Separators as at 42 are provided in a variety of configurations, that illustrated being schematically representative of a single tube horizontal device. The gas and liquid mixture enters separator 42 from tube 40 whereupon its velocity and directional flow are altered to permit fall-out of heavier liquids to the bottom of the tank as represented at 44. Gas and spray are collected in the upward portions of the separator 42 wherein smaller droplets coalesce to larger ones to join the fluid at 44 and, following final fluid particulate removal, as through mist extractors or the like, gas enters outlet conduit 46 of the sales line. Valving as represented schematically at 48 is provided within an outlet conduit for selectively drawing liquid from separator 42 and introducing it to an oil and water storage facility represented as a tank 52. Within tank 52, oil, representing a valuable product of facility 10, as well as water, as represented at 54, are retained at variable levels, a natural form of separation taking place prior to removal by trucking or the like through a valve as represented at 56.

Returning to the well structure, as the plunger 26 is propelled under gas pressure, it passes T-connection 36 whereupon it encounters a bumper structure and/or lubricator 58. The plunger 26 remains at this upward location against the bumper structure until gas flow rate diminishes to an extent permitting it to fall under gravity to its initial position against constriction 28. To permit optimized production for the well installation 10, motor valve 34 is closed to shut-in the well for an interval of time prior to the commencement of a next plunger lift and removal of the gas cap. As indicated hereinabove, the production and shut-in cycles providing optimum production vary from well to well. As a consequence, the well technician is called upon to examine various parameters of its initial performance to derive a form of signature representing the best cycling of the well through the opening and closing of motor valve 34. Once a successful cycling signature is derived, it is desirable that this cycle be retained in real time for extended durations of well production. Loss of the consistent cycling sequence can lead to difficulties in well production. Generally, an initial evaluation of a well facility 10 for determining a cycling signature involves the observation of the differential pressure between tubing string 22 and casing 12. This difference, in general, represents the height of fluid 32 above plunger 26. The pressure responses are monitored and timed and a controller is programmed to provide sequentially occurring on and off or producing and shut-in states of performance for installation 10. A controller for carrying out timing of the cyclical operation of facility 10 is represented generally at 60. The principal operation of a controller as at 60 provides for the carrying out of a cyclical actuation of motor valve 34. For example, at appropriate intervals, controller 60 applies or releases lower pressure drive gas, i.e. at a pressure of about 25 p.s.i.g. through a conduit 62 to the diaphram drive of motor valve 34. A supply of this lower pressure gas is derived from the wellhead as through conduit 64 which leads to a filter and regulator 66 and thence to the input of a control valve positioned within controller 60. For some installations, a separate supply of drive gas is provided, for example, a bottled gas supply.

With the advent of controllers as described in the above-noted U.S. Pat. No. 4,150,721, a capability of monitoring a plurality of production parameters to provide an override over the otherwise dominant cycle control of motor valve 34 is provided. For example, a switching gauge 70 is connected to wellhead 20 in a manner wherein it monitors casing pressure. Should this pressure continue to fall to a dangerously low level following the opening of motor valve 34, an indication may be present that liquid is building up in the tubing and casing faster than it is being expelled. Accordingly, the operator may wish to override a timed production cycle and shut-in the well upon this pressure reaching a certain level. This may be carried out by an electrical switching communication between gauge 70 and controller 60. Pressure responsive switching gauges which may be utilized as above described are available in the market, for example, being produced by Frank W. Murphy Manufacturing, Inc., Tulsa, Oklahoma. Generally, a normally open, single-pole, single-throw switch which closes at a programmed pressure level is incorporated within such gauges.

A magnetically actuated proximity switch is shown at 76 positioned adjacent the upper extension of tubing string 22 and somewhat adjacent bumper 58. This switch is actuated when plunger 26 is in its uppermost orientation. Incorporating a normally open switch which is closed upon the plunger 26 reaching that upward orientation, the switch affords the development of a production interval which is determined by the physical movement of plunger 26, as opposed to the utilization of a predetermined fixed interval. As before, appropriate electrical communication is made between switch 76 and controller 60.

Positioned upon conduit 40 on the sales line side of motor valve 34 is another switching gauge 82 which serves to monitor the line pressure aspects of the gas distribution system. Particularly where compressors and the like are incorporated in such distribution systems, high pressure fluctuations may be encountered. Where line pressure exceeds predetermined limits, it is important to override the operation of the well, inasmuch as plunger 26 may be prevented from performing a full cycle, whereupon the well will rapidly commence to be loaded up to the point of failure. Accordingly, gas pressure at the sales line is monitored by gauge 82 which is electrically associated with controller 60.

Another parameter of operation over which monitoring may be desired is that of the velocity or flow of gas as it is initially presented to the sales line. FIG. 1 reveals the presence of a flow rate switching gauge 90 measuring the differential gas pressure across a restriction within line 46. In their normal application, gauges, as at 90, are used for purposes of billing for measured amounts of natural gas. For any given tubing geometry, at a given pressure, there exists a critical gas velocity below which liquid will not be entrained. The switching flow meter type pickoff as at 90 can be utilized to monitor such an input and cause the well to be shut in where velocities are not maintained. Low gas flow values also will reflect that the well production is diminishing to an extent wherein a shut-in procedure should be carried out. As before, gauge 90 is electrically associated with controller 60.

In addition to the performance monitoring of the installation 10, monitors additionally may be provided looking to the safety aspects of well system performance. For example, a normally open high liquid level responsive switch may be provided both within separator 42 as well as storage tank 52. Such switches are shown, respectively, at 92 and 94. Liquid level responsive switches are available in the market, being produced, for example, by Dover Corporation, Norris Division, Houston, Texas. As before, an electrical association is provided between switches 92 and 94 and controller 60.

While the override functions provided by the above-discussed switching gauges and the like have been found to be highly valuable to the industry, the great variance in the physical layout and association of components of one well installation 10 as opposed to another has led to limitations in their use.

Several of the situations which occur from one well installation to another are outlined in the discourse immediately following. Of course, a broad variety of other such conditions may arise depending upon the environment and terrain as well as the characteristics of the well being considered. The present invention looks in particular to a singular controller 60 which is capable of accommodating great numbers of the varying situations while remaining of a universal design not requiring specific adaptation to a specific well installation production requirement.

In many rugged terrain situations, the length of tubing, for example, as at 38 extending from T 36 to motor valve 34, or as at 40 extending from motor valve 34 to separator 42, may be quite extensive.

Often, because variations in the amount of fluid within slug 32 which occurs for any given lift cycle, it is desirable to shut in the well assembly at such time as plunger or rabbit 26 reaches its uppermost position against bumper 58. Proximity switch 76 normally then will command controller 60 to close the motor valve 34. Where lengthy tubes are involved at 38 or 40 or both, for example, lengths amounting to 2,000–3,000 feet, then an amount of liquid may remain in the tubing following the closure of valve 34. In cold weather, the fluids in these tubes may freeze and block the system. Thus, the otherwise advantageous use of switch 76 for carrying out a shut-in procedure places the system production in jeopardy.

As another situation which may arise, it has been pointed out that differential pressure gauge 90 serves to measure and, in effect, detect the flow of natural gas within the system. Thus, should the differential pressure measured by gauge 90 fall below a predetermined set point, an indication will be present that the well is loading up and that a signal to controller 60 commanding a shutting in of the well should be provided. However, in many occurrences when motor valve 34 initially is opened, an erratic differential pressure will be observed at gauge 90. Looking additionally to FIG. 2, such erratic representations of differential pressure are represented by curve 96 as occurring from the point of turn-on to that instant in time when plunger 26 reaches its uppermost position, i.e. "surfaces." Assuming dashed line 98 to represent the threshold turn off level for gauge 90, without some form of correction, motor valve 34 will be commanded to prematurely shut in the well.

Looking additionally to FIG. 3, a stylized graph of the utilization of switching gauge 82 is revealed. This gauge may be operated such that it will cause a well shut-in in the event that natural gas line pressure exceeds a predetermined normal level represented by dashed line 100, a normal range of line operation being shown between dashed lines 100 and 102. The actual monitored line pressure is represented by line 104 and shows an abnormal region at 106 which may represent a compressor shutdown in the gas sales line, a plugged sales line due to a form of freezing or the like, or a closed valve in the line. Under such conditions, the gauge 82 would react properly by causing controller 60 to shut in the well. However, during such intervals when the controller 60 opens motor valve 34, very often a line pressure surge will be exhibited having a short interval, such pressure surge being represented at region 108. Utilizing existing controller devices, such a surge would cause the well controller 60 to react prematurely by closing motor valve 34.

With the renewed interest of industry in natural gas production, a common practice has been the utilization of compressors within sales lines. In consequence, the pressures of those lines becomes somewhat erratic and plunger lift in turn may be influenced by such pressures. Thus, it becomes quite difficult to predict the interval of time which may be required for plunger 26 to surface. A similar situation occurs where within a given well region, the amount of fluid slug 32 varies from cycle to cycle. Such situations make the maintenance of the well and prevention thereof from loading in quite difficult. Further, in some circumstances, it may be desirable to shut the well in when the pressure witnessed at gauge 70 falls below a predetermined level. However, if the occurrence of that threshold level falls within the period of movement of plunger 32, the fluids will be trapped within the well system, a highly undesirable condition.

Another condition obtains in conjunction with the servicing of old wells or development of new wells. At a certain point in the servicing procedure all piping or tubing will be at a zero pressure from the motor valve outward. Thus, all gauges are sitting in an alarm condition. It is desirable to provide some form of a reset condition and additionally for maintaining the real time accounting of proper cycling times.

It further may be observed that the sequential variations as aboved described also will occur in conjunction with the use of controllers 60 as regulators of natural gas utilized for injection techniques. Of particular importance, the controllers must be capable of controlling the injection of gas to within seconds for each cycle. Failure of such control will result in a considerable amount of inaccurate natural gas flow over the period of operation of a well. The same peripheral switching which monitors plunger lift devices operates in conjunction with gas injection wells. For example, a switch representing an overflow on a tank or a pressure gauge monitoring for broken tubing lines may provide for the terminating of all gas injection. Similarly, some such wells may commence producing at relatively high flow rates while being injected and, thus would continue to produce without gas injection, a condition which can be monitored with a tubing pressure gauge. On such occurrences, it would be desirable to terminate all gas injection until the desirable situation ceases.

Thus, it may be seen that controllers at 60 must have a capability of accommodating to a broad variety of production sequences while retaining a universal design permitting their fabrication within acceptable cost levels.

The improved controller 60 formed in accordance with the instant invention is revealed in perspective at FIG. 4. Looking to that figure, it may be observed that the controller is formed having a principal housing component 110, the forward portion of which retains a circuit housing or module 112, the operational surface thereof facing outwardly. Housing 112 is retained in place by four thumb screws 114 positioned at the corners thereof. A hinged front cover is shown at 116 having a window 118 formed therein and which hingedly closes over the front or operational surface of housing 112 in watertight secure fashion against housing component 110. The watertight integrity is assured through the use of an O ring seal 120 positioned within a corresponding groove within the inward surface of front cover 116. Both the housing component 110 and cover 116 preferably are formed of an impact resistant fiber reinforced thermosetting resinous material, and they are hingedly joined at hinge components 122 and 124.

Looking to the operational face of module 112, note that a liquid crystal digital readout 292 is provided beneath a window 126. In addition to providing for 7-segment digital readouts, in conjunction with an hours and minute representation, or minutes and seconds, the device also provides a colon and two-spaced dots or status indicators, one being positioned above a "SIGNAL ON" label, and the other being positioned above a "SIGNAL OFF" label. The data provided by the display 292 selectively show the operator the number of hours and minutes or minutes and seconds remaining in any given on or off period for motor valve 134 as well as the condition of cycle, i.e. whether the motor valve is in an on timing state or condition (SIGNAL ON) or is off, a state or condition representing a shut-in period. The colon is utilized to indicate normal operational conditions as well as such conditions as the receipt of some external condition signal or the actuation of a function key. The display also is selectively utilized to provide a visual feedback with respect to the insertion of data for changing on and off times as well as data related to delay periods and the like to be discussed in more detail later herein. Operator inputs to the controller 60 are provided by a keypad of the flexible and sealed variety represented generally at 130. Keypad 130 includes ten numerical keys (0-9) as well as six functional keys, two for showing a selected on or off delay condition; two for displaying the previously selected on and off times, and two keys designated "ON" and "OFF" which may be depressed to cause the controller 60 to assume either an on or an off state representing, respectively, the producing of the well or the shutting in thereof. Such keypads are marketed, for example, by Sheldahl, Inc., Northfield, Minnesota.

Figure 5:
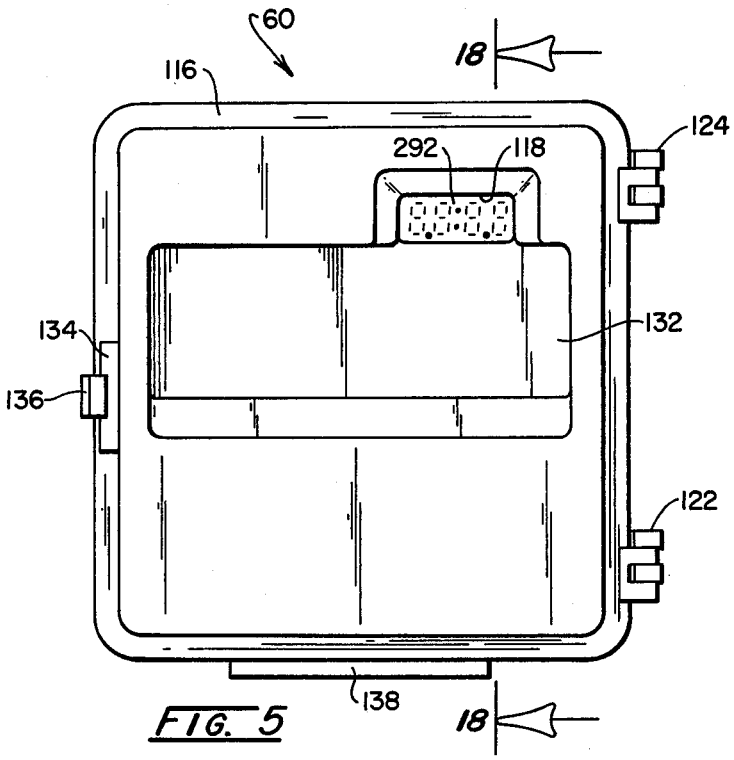
FIG. 5 is a front elevational view of the controller of the invention.
Figure 6:
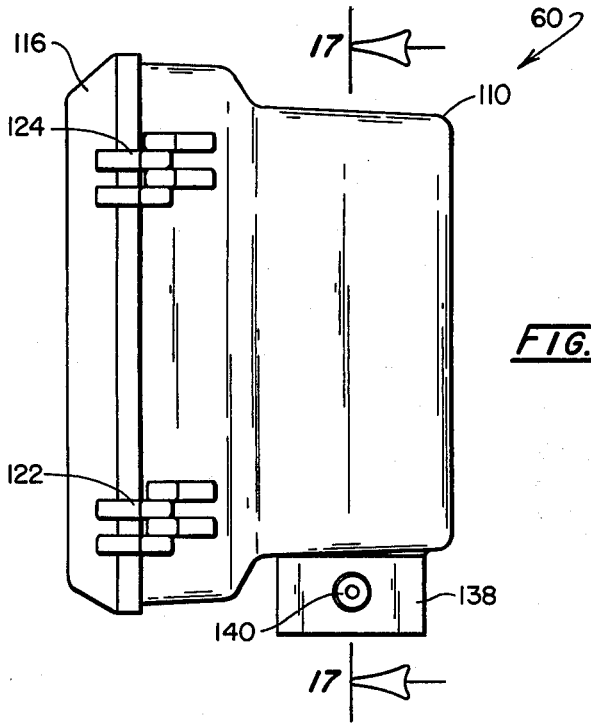
FIG. 6 is a side elevational view of the controller according to the invention.

Looking additionally to FIG. 5, the recessed region 132 within which window 118 is positioned is revealed. This region is formed within front cover 116 to provide a shielding of the liquid crystal readout 292 from direct sun rays. This serves to protect the readout, it being understood that the device 60 operates under severe environmental conditions particularly in off-shore locations. The latch for cover 116 is shown to include a built up region 134 on cover 116 which operates in conjunction with a stainless steel cam latch 136. The gas drive output of controller 60 is shown in FIGS. 5 and 6 at manifold block 138 which includes two female threaded outlet fittings 140 and 142, the latter being represented in FIG. 17. These fittings extend to motor valve 34 for driving the same in conventional fashion.

The basic operation of controller 60 is one wherein a pair of solenoids are selectively energized to actuate a shuttle valve to drive motor valve 34 to in turn, cause the driving of motor valve between open and closed positions. As is described later herein, the shuttle valve and solenoids themselves are retained within a cavity 750 within housing component 110. Power supplied for the solenoids as well as operating a logic circuit is from replaceable D-type batteries also located within the noted cavity 750.

Looking to FIG. 4, a pictorial representation is provided as to what the operator observes upon approaching controller 60 and opening its front cover 116. Initially confronting an operative device, the operator will observe the display at 292, the decimal point being illuminated to indicate an on state wherein the well is being produced or an off state indicating that the well is shut in. The colon will be blinking at a rate of about 1 cps representing normal operation, and the numerical display in hours and minutes for an off cycle, or in minutes and seconds for an on cycle will show the amount of time remaining in that cycle before a changeover from one to the other. The selection of these time elements may be varied in accordance with design choice. So that the operator can determine what previous cycling intervals are in operation within controller 60, he or she merely depresses one or the other of the "DISPLAY ON" or "DISPLAY OFF" functional keys. Upon such depression of the keypad function key, the earlier determined cycle interval will be displayed. However, for the ensuing 7 seconds commencing with the depression of either of these functional keys, the operator may insert a new on or off cycle interval time by depressing the numerical keys. Each depression commences a new 7-second interval, and the corresponding number character is displayed at the right side of display 292 until shifted to the left on the occasion of a next numeric key depression. At the termination of the last to occur 7-second interval, the system will commence operation with the new values. It may be observed that the operator is not called upon to carry out elaborate programming instructions. Only the simplest of procedures are required to change state times, and the system automatically re-enters on an operational cycle at the termination of the last to occur 7-second interval.

The control system of controller 60 also incorporates a feature which permits it to ignore override shutdown switching inputs which result from spurious and temporary conditions as described, for example, in FIGS. 2 and 3. For example, the operator has the capability with the improved apparatus to impose a delay following the receipt of any initial signal imposed thereinto commanding it to shut in a well. Similarly, a delay may be imposed for any command to open up the well. By carefully adjusting the length of such delays, essentially normal operation may be provided through the select ignoring of spurious signals. Of particular importance, the predetermined regular cycle of opening up and shutting in the well continues uninterrupted notwithstanding the externally generated but ignored spurious signals. Insertion of the delays on the part of the operator is quite simple. Looking again to FIG. 4, to observe the existing delay imposed upon signals commanding the controller to open the well or to shut in the well, the operator merely pushes one of the respective ON DEL or OFF DEL functional keys of keypad 130. Upon pushing the selected delay function key, the existing or preset delay figure will be displayed at 202. Following the initial depression of such function key, the operator again is given the option during a 7-second interval to insert any new delay time by the simple expedient of pressing the numerically designated keys. As the numeric keys are pressed, the corresponding digit character appears at the right of display 292. This character then is shifted to the left with the depression of a next numeric key. The sequence continues for all digits, and the 7-second delay interval is renewed with each key depression. During the changes in the selectd delays or in the cycle periods, the colon at display 292 will assume a steady state on condition. This condition also obtains during periods in which an externally derived on or off override signal is received and has been reacted to by controller 60. The first two digits of the display 292 will flash at a frequency of 0.5 cps, which is immediately discernable to the operator in the event that the battery power supply has commenced to become inadequate.

The improved controller 60 also enjoys a capability for accommodating to operational sequences more elaborate than the above-discussed delay features. Also insertable as signals into controller 60 are inputs designated "set" and "reset." Controller 60 responds to an external signal applied at a set terminal to cause it to ignore all incoming external signals until a reset condition has obtained. With such an input, a response, for example, an on-state condition may also be utilized to cause a set condition which will obtain until a signal is received permitting normal cycling operation. For instance, the surfacing of plunger 26 and detection thereof at 76 as discussed in conjunction with FIG. 1. With such an arrangement, a complete accommodation of the cycle to an unusually varying plunger 26 movement is achieved. However, during any set condition of controller 60, the predetermined production and shut-in cycle continues to be timed out in real time notwithstanding the externally evolved input signals. These features will become more apparent as the description of the circuitry of controller 60 unfolds.

Figure 7A:
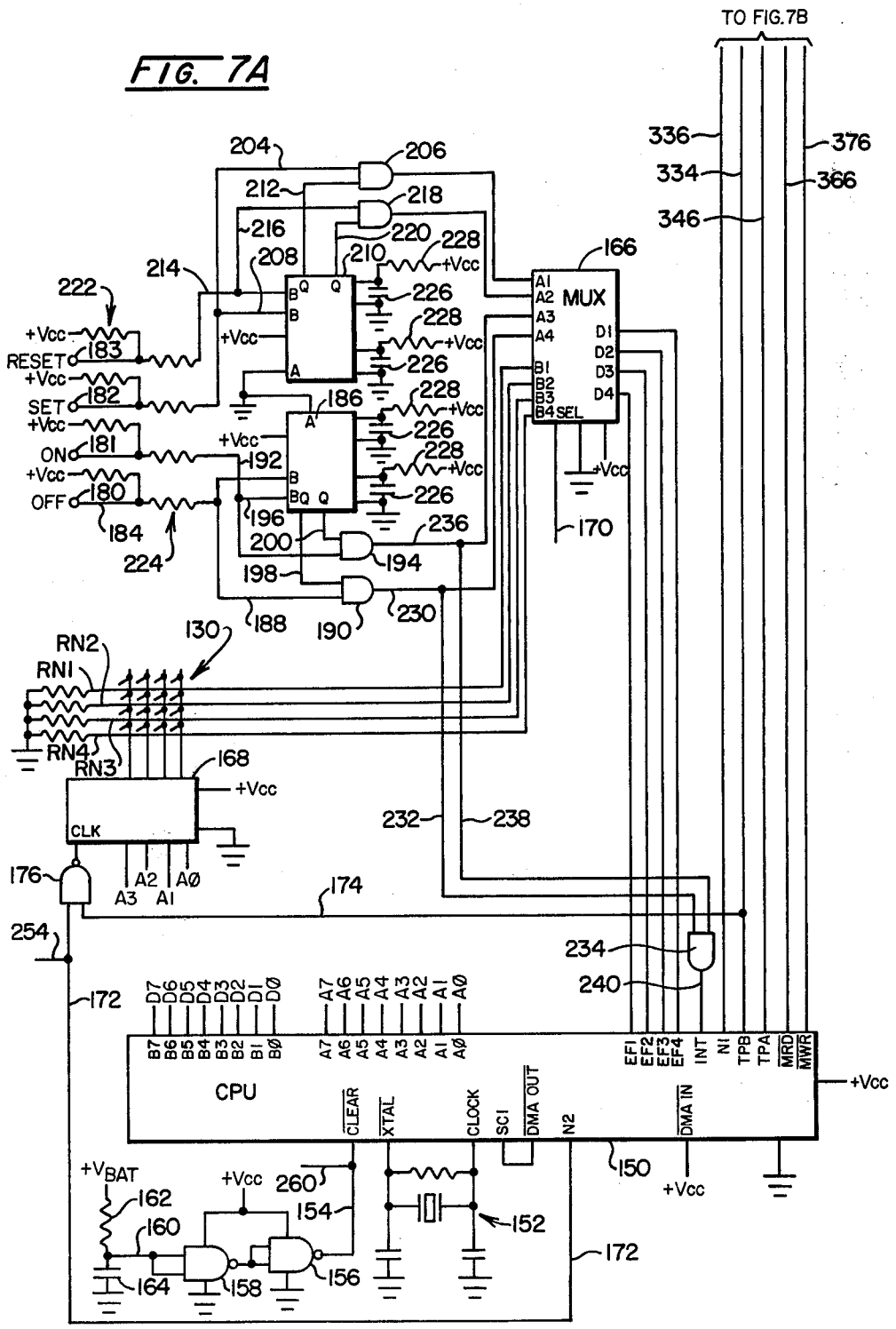
FIGS. 7A–7C provide a schematic representation of the control circuit of the controller of the invention.

Referring to FIG. 7A, the circuit of controller 60 is shown to operate in conjunction with a microprocessor (CPU) represented at 150. Microprocessor 150 is one selected for use within a system having limited power supply capability which, for the instant case, is provided by onboard conventional D-type batteries. Accordingly, the device as well as all components of the circuit utilize complementary-symmetry MOS technology (CMOS). Responding to read only memory contained microinstructions in conventional fashion, microprocessor 150 requires no minimum clock frequency, is byte oriented and includes four I/O flag inputs, EF1-EF4. Data transfer is carried out by activating one of the flag lines, the interrupt line or a DMA line, the latter of which is used for a different purpose. Timing signals, TPA and TPB, are used by the input output components in memory to signal a new processor state code, to latch memory address bits, to take memory data from the bus and to set and reset I/O controller flip-flops. Note additionally that the data busses are bidirectional. During a memory write cycle, the byte to be written appears on the data bus, either from CPU 150 or from an I/O device, and a memory write pulse is generated by CPU 150 at an appropriate time. During a memory read cycle, a memory read level output is generated which is used by the system to gate the memory output byte onto the common data bus for use by CPU 150 for an associated I/O device. CPU 150 utilizes 8 memory address lines. These 8 lines supply 16-bit memory addresses in the form of two successive 8/bytes. The more significant (high order) address byte appears on the address lines first, followed by the less significant (low order) address byte. In its general architecture, CPU 150 includes a register array consisting of sixteen 16-bit scratch pad registers. These registers are designated higher order and lower order as set forth above. A single phase clock input to CPU 150 determines operating speed, while the clear input thereto initializes the microprocessor and its release starts instruction execution. Such microprocessors are marketed, for example, as Model CDP 1802CE by RCA, Inc., Summerville, New Jersey.

The CLOCK and XTAL inputs to CPU 150 are driven by a crystal oscillator 152 which operates at a relatively low frequency of less than about 300 KHz, for example, 288 KHz. This frequency value is, for example, one tenth of the frequency levels generally utilized for central clock inputs to microprocessor systems. The utilization of this low frequency, while accommodated for later herein, lowers the power demand of the entire system to an extent permitting the use of the noted conventional dry cell battery inputs. It may be observed in the above regard that power utilization by the circuitry is proportional to the square of this frequency. Operational intervals amounting to about one year are available with the arrangement. The flag inputs, EF1-EF4, to CPU 150 respond to information generated either from keypad array 130 or to externally generated switching signals. The intialization of CPU 150 is provided at the $\overline{\text{CLEAR}}$ terminal from line 154. Line 154, in turn, is coupled to the output of two serially connected NAND Schmidt triggers 156 and 158. Exhibiting a hysteresis characteristic, the inputs to gate 158 are derived from line 160 which is coupled to a point intermediate timing resistor 162 and capacitor 164 of an R-C timing circuit. Thus, upon the assertion of battery power, $V_{BAT}$, a pulse of predetermined duration is applied to the $\overline{\text{CLEAR}}$ terminal transitioning it from low to high logic values during such interval as the crystal 152 responds to power assertion and reaches its operational frequency. Additionally, an initialization of CPU 150 takes place in response to the input at line 154.

The N designator terminals of CPU 150 are represented at N1 and N2, the signals present at these terminals designating one of the above-noted 16 registers to be acted upon during register operations as well as to provide a command or selection code for peripheral components. The TPA and TPB terminals of CPU 150 provide positive pulses that occur once each machine cycle, a pulse at TPB following that at TPA. These pulses are utilized by peripheral components to interpret codes and time appropriate interaction with the data bus. Read and write commands emanate from CPU 150 at the $\overline{\text{MRD}}$ and $\overline{\text{MWR}}$ terminals in conventional fashion, while a correspondingly conventional interrupt input is assertable at the terminal designated INT. The bi-directional data bus terminals of CPU 150 are designated B0-B7 while the address bus terminals carry the designation A0-A7. The above-noted labeling is carried through each of the circuit containing figures 7A–7C to simplify and clarify the description of the interconnections of the system as will be apparent in the discourse which follows.

The flag inputs EF1-EF4 to CPU 150 derive from the output of a multiplexer 166. Multiplexer 166 serves to provide 4-line output data selection in consequence of corresponding data supplied at its 8-line input. The component may be present, for example, as a type CD40257B manufactured by RCA Corp. (supra). The 8-line inputs to multiplexer 166 are derived, as indicated above, from the external switching terminals, such inputs being represented at terminals A1-A4 or from the keypad 130 assembly, such data being asserted at terminals B1-B4.

Looking to the keypad 130 inputs to multiplexer 166, the keypad circuit is again represented in general at 130 as being arranged in row-column fashion. In this regard, the column designations, COL1-COL4, are shown extending to four corresponding outputs of a clocked "D" latch 168. Latch 168 contains four latch circuits, each strobed by a common clock input at its clock terminal CLK. The inputs to latch 168 derive from CPU 150 and are presented at the designated line inputs A0-A3. A scanning approach is utilized in operating the keypad array 130, a progressive logic high signal being presented at the latch 168 outputs which is witnessed at the interconnection of the designated output column and a corresponding row designation RN1-RN4. Note that these designated lines extend from common connection with the column lines through discrete resistors to ground and from the connections also extend to the respective B1-B4 inputs of multiplexer 166. Responding to an appropriate logic level at its select, SEL, terminal input at line 170, multiplexer 166 presents the row, RN1-RN4 designated logic levels at its output for submittal to flag inputs EF1-EF4 of CPU 150. In conventional fashion, CPU 150 compares the A0-A3 data submitted to latch 168 with the scanned row outputs at its flag inputs to determine the presence of an identification of that key of the possible 16 keys which may be depressed at keypad array 130. Latch 168 is clocked in the presence of an N2 terminal select input at line 172 as well as a timing pulse B, TPB signal at line 174 input to an AND gate 176 having an active low output extending to the designated clock CLK terminal.

The override or external switching inputs to the circuit are represented in the figure as a terminal 180 labeled "OFF"; a terminal 181 labeled "ON"; a terminal 182 labeled "SET"; and a terminal 183 labeled "RESET". Terminal 180 is coupled through line 184 to the B input terminal of a dual, retriggerable, resettable monostable multivibrator 186. The signal level at line 184 also extends through line 188 to one input of an AND gate 190 coupled to operate to provide a NORing function. In similar fashion, ON terminal 181 is coupled through line 192 to one input of an AND gate 194 which also provides an NORing function. Line 192 also extends through line 196 to the B terminal input of multivibrator 186. The Q terminal output of multivibrator 186 corresponding with the line 184 input is provided at line 198 which extends to gate 190, while the Q output terminal corresponding with the line 196 input is provided at line 200 extending to an input to gate 194. All A terminals of multivibrator 186 are coupled with ground as represented at line 202.

In similar fashion, the SET terminal 182 is coupled through line 204 to one input of AND gate 206 and through line 208 to the B input terminal of a dual retriggerable, resettable monostable multivibrator 210. The Q output terminal of multivibrator 210 corresponding with the line 208 input is provided at line 212 also extending to an input of gate 206, gate 206 carrying out a NOR function. RESET terminal 183 is connected through line 214 to another B input terminal of multivibrator 210 and through 216 to one input of AND gate 218, while the Q terminal input of multivibrator 210 corresponding with the line 214 input is provided at line 220 extending to the opposite input of gate 218. The normal logic level asserted at lines 188, 196, 204 and 216 of respective gates 190, 194, 206 and 218 are high. The opposite inputs to these gates are normally low. The B input terminals of multivibrators 186 and 210 have corresponding logic levels. Discrete pull up resistors represented within the grouping 222 thereof maintain high values at their corresponding line couplings. The resistors within array 224 serve a current limiting function. Thus, a logic low at any one of the terminals 180-183 represents an active switching condition. Monostable multivibrators 186 and 210 produce an accurate output pulse of predetermined width, the duration of which is determined by external timing capacitors operating in conjunction with associated external timing resistors 228. This pulse detecting and stretching feature is required inasmuch as the externally derived low signal applied at terminals 180-183 may be of such short duration that the cycling rate of CPU 150 may be inadequate to detect them. Recall in this regard that clock function 152 operates as 288 KHz, a relatively low frequency value selected to achieve low power drain and permit continuous operation over lengthy intervals of time. On the other hand, the direct connection of the terminals to gates 190, 194, 206 and 218 permits a signal which continues and is persistent to be continually observed beyond the pulse width otherwise defined at multivibrators 186 and 210. The latter multivibrators may be present, for example, as type MC14538B dual precision retriggerable/resettable monostable multivibrators marketed by Motorola, Inc., Austin, Texas. Output of gate 190 is provided at line 230 extending to the A4 input terminal of multiplexer 166 as well as through line 232 to one input of NOR gate 234. Similarly, the output of gate 194 at line 236 extends to the A3 input terminal of multiplexer 166 as well as through line 238 to the opposite input of gate 234. The output of gate 234 at line 240 is directed to the interrupt, INT, terminal of CPU 150. Accordingly, with the presence of an active low externally derived output signal at the ON terminal 181 or the OFF terminal 180, an interrupt routine is carried out. As indicated earlier herein, the multiplexer 166 serves to provide an 8-line to 4-line multiplexing function, the output terminals thereof D1-D4 being coupled with respective flag inputs EF4-EF1 of CPU 150.

Figure 7B:
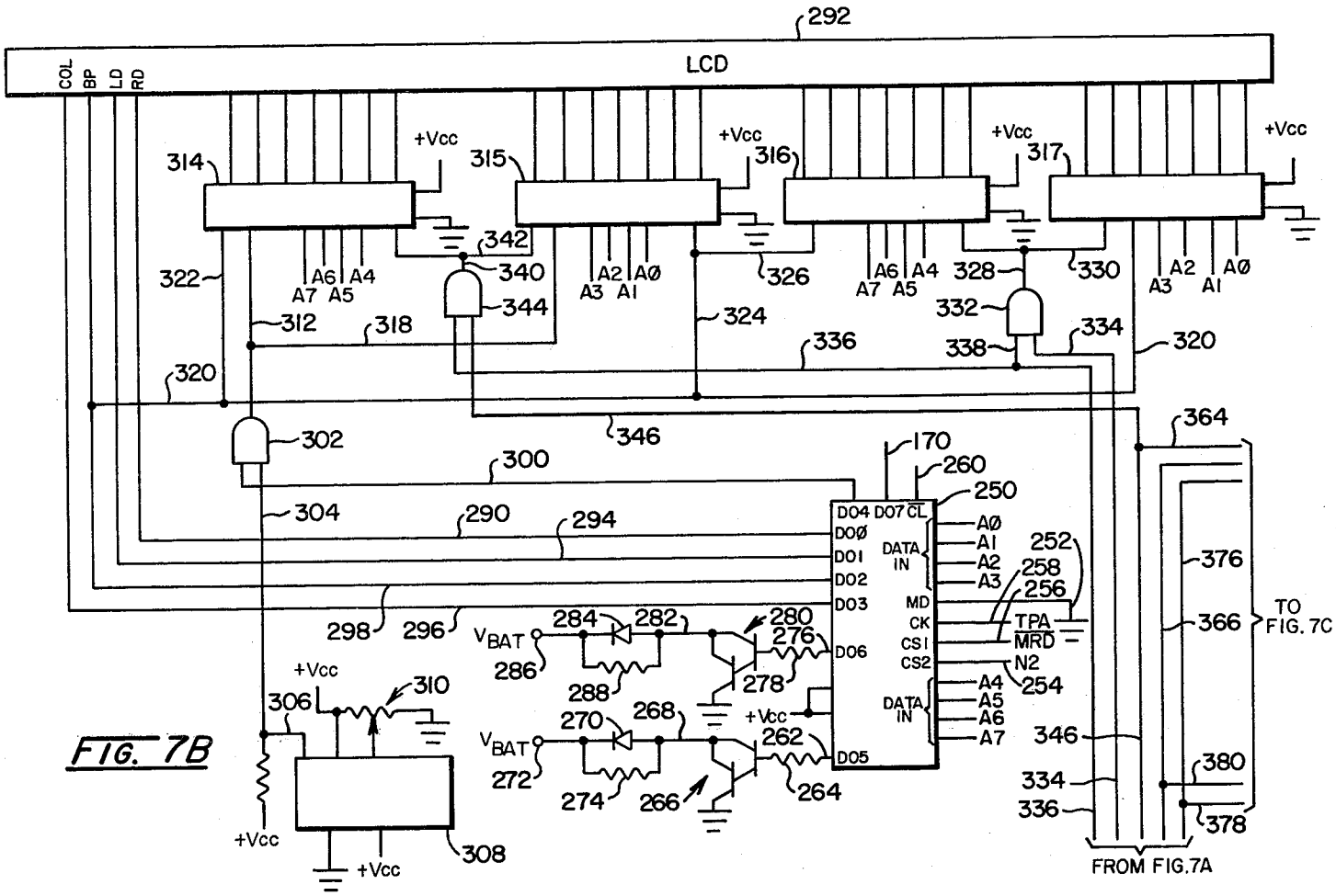

Looking to FIG. 7B, and 8-bit address latch is revealed at 250, the data in ports of which are coupled to receive sequentially presented 8-bit instructions from along address bus leads A0-A7. This device may be present, for example, as an 8-bit, mode-programmable COS/MOS input/output port of a type CDP1852 marketed, for example, by RCA, Inc. (supra). The device is operative as an input port by providing a logic low at its mode, MD, port as is provided by line 252. Enablement of latch 250 is provided with the assertion of an N2 designator signal from along lines 172 and 254 in combination with a memory read signal from the $\overline{MRD}$ terminal of CPU 150 as represented at line 256. The clock input to latch 250 derives from the timing pulse A (TPA) terminal of CPU 150 as represented at line 258, while the clear signal imposed at the $\overline{CL}$ terminal thereof is derived from line 260 extending to line 154 which, in turn, carries the earlier described power-up reset signal.

The 8-bit word presented to the data in terminals of latch 250 from CPU 150 is used to carry out a number of functions including the selective energization of the windings of solenoids operating a shuttle valve which, in turn, operates motor valve 34, the difference of operation of the colon of the digital readout located at 126; requisite back plane and decimal identification of the digital readout. Additionally, a flashing indication for low battery conditions with respect to the first two digits of the readout is provided by the outputs of latch 250. Looking to those outputs individually, output terminal DO5 is coupled to line 262 which incorporates resistor 264 and is coupled to the base of Darlington connected transistor pair 266. The emitter terminal of transistor pair 266 is coupled to ground while the collector thereof is coupled through line 268 incorporating diode 270 to the +V battery supply represented by terminal 272. One solenoid winding 274 of the noted shuttle valve is shown coupled across diode 270 between terminal 272 and the collector of transistor pair 266 at line 268. Thus, with the assertion of a logic high value at line 262, transistor pair 266 is turned on to permit conduction of current through winding 274 to actuate the noted shuttle valve in a manner causing motor valve 34 to open. This output at line 262 is sustained for about ¼ second. In similar fashion, data output terminal DO6 of latch 250 is coupled through line 276 including resistor 278 to the base terminal of Darlington coupled transistor pair 280. The emitter of transistor pair 280 is coupled to ground, while the collector thereof is coupled by line 282 incorporating diode 284 to the +V battery power supply at terminal 286. As before, the solenoid winding 288 of the earlier described shuttle valve is coupled between terminal 286 and across diode 284 to line 282. Thus, with the imposition of a logic high signal at line 276 for the noted ¼ second duration, transistor pair 280 is turned on, in turn, to permit the energization of winding 288. When thus energized, winding 288 causes the noted shuttle valve to be actuated, in turn, to cause motor valve 34 to turn off or shut in the well facility.

Output port DO0 of latch 250 is coupled by line 290 to the right dot or decimal point control input of a liquid crystal display component represented by block 292. Component 292 may, for example, be present as a 4 digit, reflectorized liquid crystal display marketed as type FEO202D by AND of William H. Purdy Co., Burlingame, California. Thus, with the display of the right dot, as described in connection with FIG. 4, an off or well shut-in condition is effected at motor valve 34. Correspondingly, the DO1 output port of latch 250 is coupled by line 294 to the left dot or decimal control of LCD display 292. When this dot is displayed, as described in connection with FIG. 4, an on condition obtains wherein the well facility 10 is permitted to be produced by motor valve 34.

The display of the colon of LCD 292 is controlled by signal inputs to the colon control terminal thereof from line 296 which, in turn, extends to the DO3 output port of latch 250. It may be recalled that the colon is flashed at a 1 CPS frequency during conventional timeout of on or off states and is displayed in steady-state fashion during any functional change carried out by the operator or in the course of operator commands for readouts from the display 292. The backplane of LCD 292 is driven at a requisite 30–60 Hz frequency by a corresponding signal presented at its BP terminal from line 298. Line 298, in turn, extends to the DO2 output port of latch 250. Output port DO7 of latch 250 is coupled to the earlier described line 170 which extends to the select, SEL, terminal of multiplexer 166 (FIG. 7A). The signal thus imposed causes the multiplexer 166 to select alternately keypad signals at its B1-B4 inputs or inputs from the external switching terminal array 180-183 at its A1-A4 terminals. Finally, the DO4 output port of latch 250 is coupled by line 300 to one input of an AND gate 302. The opposite input to AND gate 302 is provided at line 304 which is normally held at a low logic level. Line 304, in turn, is coupled to line 306 which, in turn, leads to a low voltage detector represented by block 308. Detector 308 responds to a trim adjustment at potentiometer 310 to cause the signal at line 306 to revert to a logic high when the level of battery voltage +Vcc reaches a predetermined threshold. As a consequence, a fluctuating signal at line 300, for instance, provided at 0.5 cps in combined with the signal at line 304 to provide a corresponding fluctuating output at line 312 which is introduced to an enabling control terminal of a driver 314 of a grouping of four thereof 314–317. The signal at line 312 also is introduced to the corresponding terminal of a second driver 315 from along line 318. Thus, in the presence of fluctuating signals at lines 312 and 318, the first two segments of the LCD display 292 will flash at the noted rate. Drivers 314–317 may be present, for example, as BCD-to-seven segment latched/decoder/drivers. The circuit provides the function of a 4-bit storage latch and an 8421BCD-to-seven segment decoder and driver. They are marketed, for example, as type MC14543B by Motorola, Inc. (supra). Detectors as at 308 are marketed as type CD4007BE by RCA, Inc. (supra).

The phase synchronization inputs to drivers 314–317 emanate from line 298. In this regard, line 320 is shown extending from line 298 to the phase terminal input of decoder 317. The line is tapped by line 322 for provision of the phase signal to decoder 314 and is tapped similarly by lines 324 and 326 for assertion at the phase inputs of respective decoders 315 and 316. Decoders 316 and 317 are enabled simultaneously from output lines 328 and 330 extending from AND gate 332. Gate 332, in turn, receives timing pulse TPB from CPU 150 along line 334 and the instruction output signal emanating from terminal N1 of CPU 150 from along lines 336 and 338. Accordingly, drivers 316 and 317 are simultaneously enabled with the coincidence of timing pulse TPB representing low order inputs and an output instruction logic signal. The numerical data supplied to the drivers is derived as shown from address bus leads A0-A7.

In similar fashion, drivers 314 and 315 are enabled simultaneously from along lines 340 and 342 representing the output of AND gate 344. Gate 344, in turn, is connected with line 336 carrying the N1 signal from CPU 150 as well as timing pulse TPA representing high order data from along line 346. Line 346 extends to the TPA terminal of CPU 150.

Figure 7C:
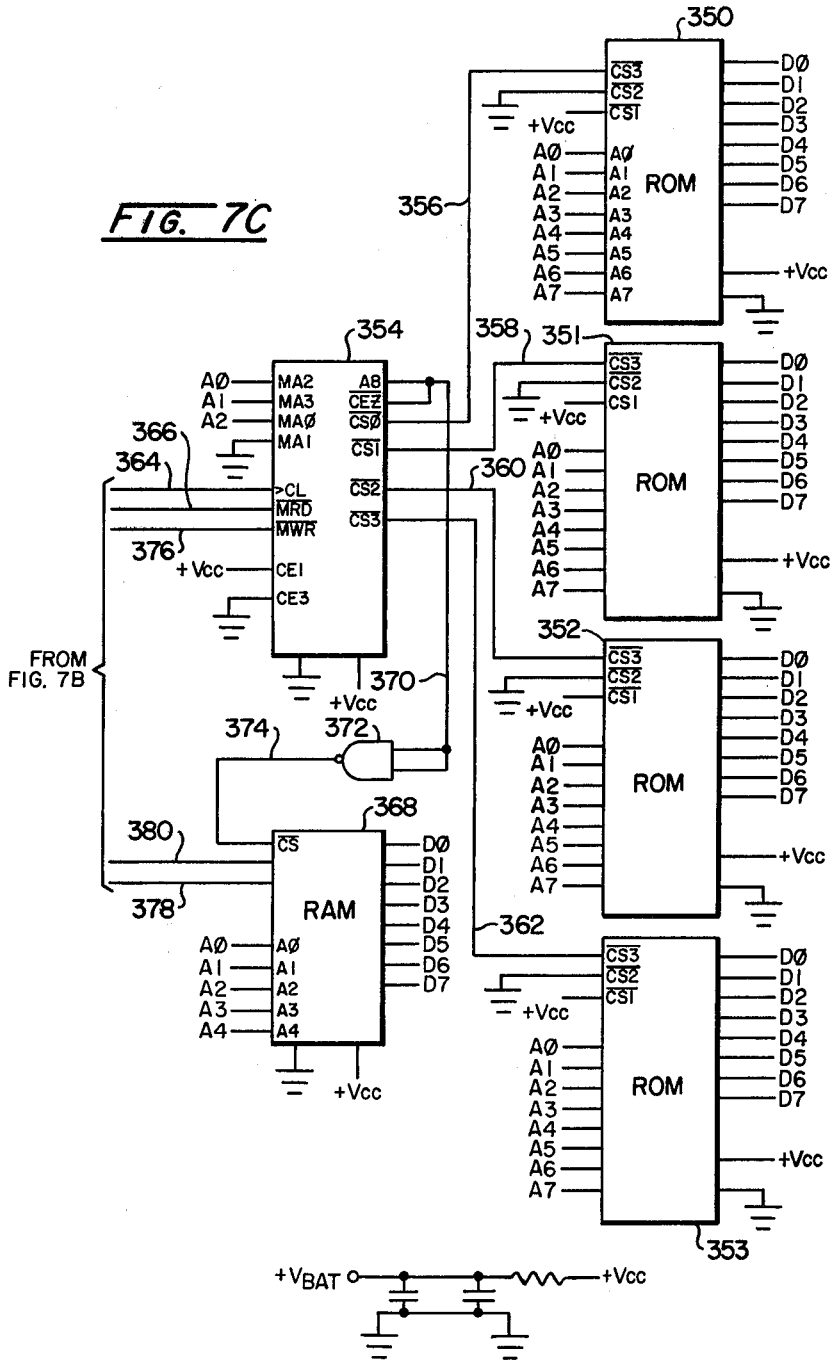

Turning to FIG. 7C, the memory components of the circuitry of the invention are revealed. The microinstructions of the control circuit are retained within four read-only memories (ROM) 350-353. In the preferred embodiment, each of the ROMs 350-353 are present as 256 word×8-bit static EEP ROMS which, in the interest of power economy are of a CMOS variety. The ROMS 350–353 may be present, for example, as type CDP1842C marketed by RCA, Inc. (supra). Addressed from CPU 150 output lines A0-A7, the corresponding address terminals are shown having like alphanumerical designation. Additionally, each of the ROMS 350-353 is provided having data output ports D0-D7 which extend to the corresponding data input ports B0-B7 of CPU 150. Control over ROMS 350-353 emanates from a decoder 354. Decoder 354 is a CMOS 4-bit memory latch and decoder which may, for example, be present as a type CDP1866 marketed by RCA, Inc. (supra). The chip selection function carried out by decoder 354 is provided in response to command inputs from CPU 150 address outputs A0-A2 respectively coupled with the memory address terminals MA2-MA0 of the decoder. The chip select output electing ROM 350 is provided from the $\overline{CSO}$ terminal of decoder 354 which is coupled via line 356 to the $\overline{CS3}$ terminal of ROM 350. Correspondingly, the $\overline{CS1}$ terminal of decoder 354 is coupled via line 358 to the $\overline{CS3}$ select terminal of ROM 351; the $\overline{CS2}$ terminal of decoder 354 is coupled via line 360 to the $\overline{CS3}$ terminal of ROM 352; and the $\overline{CS3}$ terminal of docoder 354 is coupled to the $\overline{CS3}$ terminal of ROM 353 via line 362. Selection of the ROMs 350-353 is made in conjunction with timing pulse TPA extending from CPU 150 from along lines 346 and 364 to the CL terminal thereof, in conjunction with the read command deriving from CPU 150 from along line 366 extending between the $\overline{MRD}$ terminals of each of those components.

Decoder 354 also selectively elects the utilization of random access (RAM) memory 368. This selection is made by signals outputting from the A8 and $\overline{CE2}$ terminals of decoder 354 which extend along line 370 to active low input NAND gate 372 from which the inverted signal is presented along line 374 to the $\overline{CS}$ terminal of RAM 368. An additional signal provided in conjunction with the election of RAM 368 is derived from $\overline{MWR}$ terminal of CPU 150. Note, in this regard, that line 376 is coupled from CPU 150 to the $\overline{MWR}$ terminal of decoder 354 via line 376. That signal as well as the read signal from CPU 150 also is asserted via respective lines 378 and 380 to RAM 368. The address inputs to RAM 368 are provided as address bus leads A0-A4, while the data out terminals are coupled with the data bus as represented by terminal designations D0-D7. RAM 368, as well as memory capability within CPU 150, serves the conventional purpose of storing temporary data such as time settings and the like.

The microinstructions associated with CPU 150 as retained within ROMS 350-353 are organized to operate in conjunction with the earlier described lower system clock frequency of 288 KHz. This relatively low frequency has been selected for the system in order to conserve essential power resources to permit the controller 10 to operate in remote locations for significant periods of time, for example one year, without battery replacement and while using four, small conventional D dry cell batteries. Using this principal system clock frequency, the microinstructions are called upon to define accurate time intervals ranging from one second to intervals of hours. Further, while accommodating to this necessary low frequency, the system must carry out the earlier described inversion of the signal at line 298 to the backplane of liquid crystal display 292. The system of the invention will be seen to accommodate uniquely to these requirements.

Figure 8A:
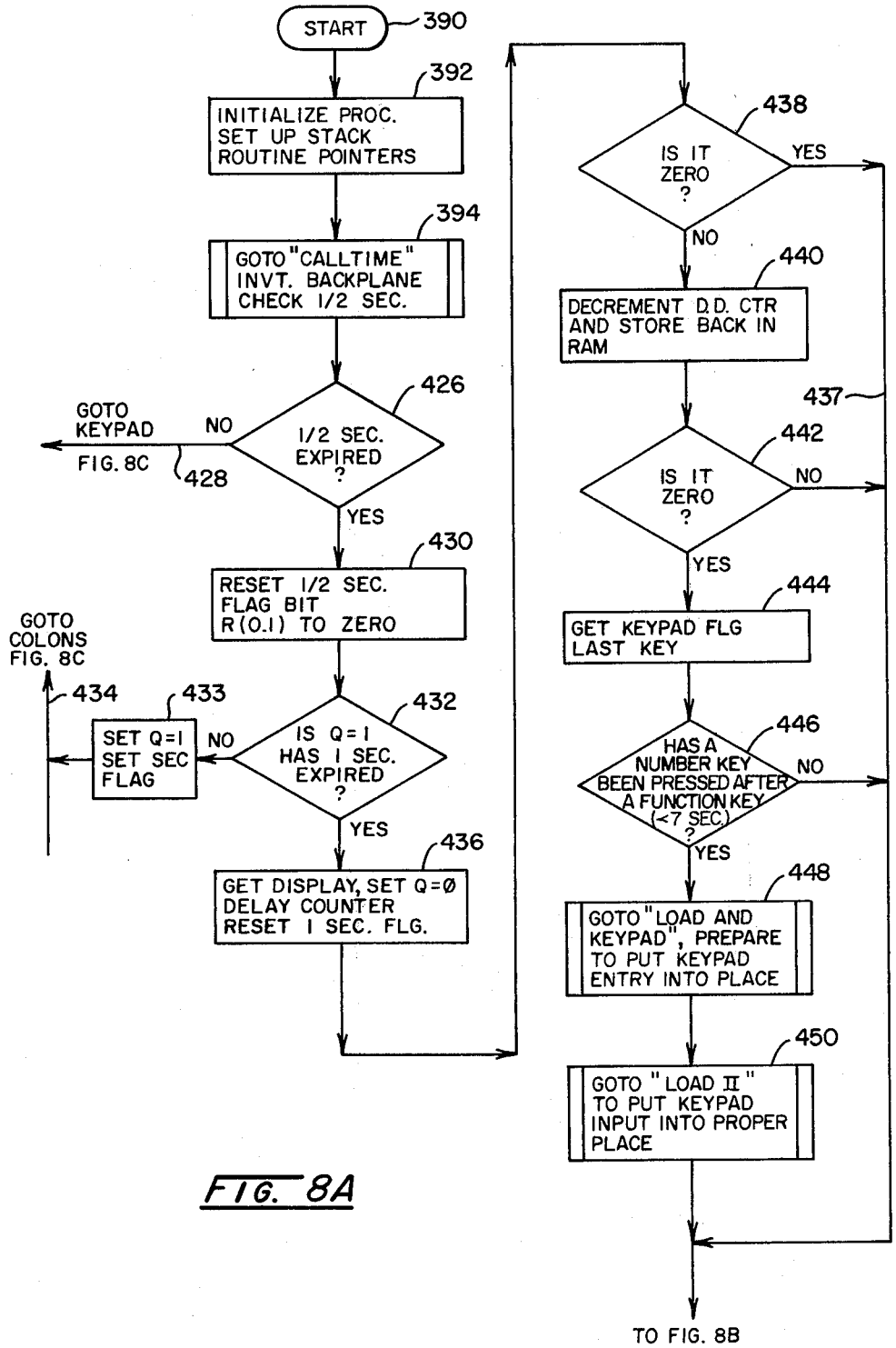

Looking to FIG. 8A, the commencement of the principal or main instructional program is revealed, start of the program being represented by terminal 390. Upon startup, as is conventional, an initialization procedure is carried out wherein registers are appropriately aligned for the locations of subroutines and the like as represented at block 392. Following initialization, as represented at block 394, the microinstructions progress into a subroutine identified as "CALLTIME," a procedure wherein the basic periodic time component or increment is defined. It is this defined increment which then is utilized in establishing on and off state timing, delays and the timing requisite for exciting the backplane of display 292. Generally, twenty-four system clock cycles are required to carry out one instruction. Such an instruction will include about eight cycles to carry out fetch routines, another eight cycles to carry out execution and, for the type microprocessor at hand, about eight cycles to carry out a DMA procedure which is generally referred to as direct memory access.

The period of the principal system frequency is $3.472\times10^{-6}$ seconds per cycle which, when multiplied by the noted 24 cycles per instruction, results in an instruction interval of $8.3328\times10^{-5}$ seconds. To establish a basic periodic time increment, a predetermined number of successive instructions are selected which, for the preferred embodiment, are 120 in number. This value provides for a 0.01 second interval for each grouping of 120 instructions. Such an interval has a value when converted to a corresponding frequency of 50 cycles per second which is desirable for carrying out the excitation of backplane of display 292. Generally, such backplane configuration should be excited at a frequency selected between about 30 and 100 cycles per second. To generate a sequence of signals having the noted $8.3328\times10^{-5}$ second duration corresponding with a twenty-four basic clock cycles per instruction basic timing component, the state code terminal of CPU 150 is coupled with the $\overline{\text{DMA}}$ OUT terminal as represented in FIG. 7A. This provides for the incrementing of the 16 bit DMA register in a manner achieving the desired basic timing increment development. The 16 bit DMA register is referred to as R0.0.

Looking to FIG. 9, the $\overline{\text{CALLTIME}}$ subroutine is revealed in flow diagrammatic fashion. The initial instruction of this subroutine is represented at block 396. This instruction provides for the loading of the DMA register, R0.0, into a CPU 150 accumulator. Such procedure is required due to the power conserving low frequency utilized. A register decrementation is required to shorter extent than the available 16 bit R0.0 register in order to derive the desired 0.01 second principal increment. Accordingly, only a portion of the decrementing state of register R0.0 is utilized and this is carried out by transferring the value at the partially utilized portion therein to the accumulator. Transfer takes place before 120 instructions are carried out to avoid an overshoot condition wherein an interval of time would otherwise be lost. For example, the loading described may be carried at the 117th instruction, whereupon, as noted in block 396, the microinstructions wait in carrying out an edge comparison to reach the falling edge of 120th instruction related pulse. This wait is represented at decision block 398 querying when a 0 condition of decrementation is reached and in the event such value is not reached, then, as represented by loop line 400, the system awaits such condition. Where necessary, such 0 condition may be established at a value less than 120 to accommodate for any system delays associated with the resetting procedures described below.

With the definition of the basic time increment as represented by a yes response to the query at block 398, then as represented at block 402, the DMA register, R0.0. is reset for decrementing in response to the pulses constituting the next block corresponding with 120 instructions. Following this reset procedure, as represented at block 404, the instructions carry out preparations to evolve an a.c. form of pulse output to the backplane of display 292, an exclusive ORing being performed with respect to another of the 16 internal registers, E.1 and 0F. Upon deriving the status of block 404, the program then commands an output to the backplane of display 292 by appropriate instruction to decoder 250 as represented by block 406. Following the command of block 406, as represented at decision block 408, the instructions determine whether or not solenoid windings 274 and 288 are being energized. In the event the response is in the affirmative, then as represented at block 410, a second inquiry is made as to whether the requisite interval of energization of such winding has taken place. In the event of an affirmative response, then as represented at block 412, an appropriate register, E.1, is loaded to provide for the termination of energization of the winding. In the event of a negative response at block 410, as represented at block 414, a pulse counter determining the requisite energization interval, for example ¼ second, is decremented to continue timing of such energization. From either of blocks 414 or 412, the subroutine then proceeds to the instructions of block 416 which provides for decrementing a counter contained within RAM 368 utilized for maintaining an account of the number of basic time increments, each representing 120 instructions, which have been encountered. This counter is utilized in conjunction with determining a next principal time increment which is selected as ½ second. Accordingly, as represented at decision block 418, the query is made as to whether the counter referred to at block 416 has reached a 0 position representing condition wherein ½ second in time has occurred. In the event of a negative response, then, as represented at lines 420 and 422, the subroutine returns to the main program and, as represented at block 424, in the event of an affirmative response, a bit or flag representing the passage of ½ second is set, and the counter, as above discussed located at RAM 368, is reset to its initial value. From block 424, the CALLTIME subroutine returns to the main program as represented at line 422.

Returning to FIG. 8A, as represented at decision block 426, the program then queries as to whether ½ second has expired, such information being represented at block 424. In the event of a negative response, inasmuch as this block is at the commencement of the program, as represented at line 428, the program jumps to the instructions associated with manipulation of the keys within keypad 130. In the event of an affirmative response at block 426, then as represented at block 430, the earlier set ½ second flag bit at register R (0.1) is reset to permit detection as to the occurrence of the next principal time increment of one second. This determination is made at decision block 432 which queries whether a one second interval has expired. The inquiry at block 432 is implemented by a one-bit latch identified as "Q" which is internal to CPU 150. In the event of a negative response, then as represented at block 433 and line 434, the program jumps to that portion providing for control over the energization of the colon at display 292. Block 433 provides for setting the seconds flag or "Q" latch to a one value. As is apparent, the state of this latch changes each half second. In the event of an affirmative response at block 432, then as represented at block 436, the one second flag or "Q" latch is reset and a display delay counter condition is acquired and inserted into an accumulator. The latter delay counter comes from a RAM location 800E of the system and serves to maintain the status of the earlier described 7-second delay which ensues with the depression of a function key at keypad 130. For example, if an "ON DISPLAY" or "OFF DISPLAY" key is depressed, a seven second delay interval will ensue during which the operator may enter a new numerical valuation or permit the earlier inserted valuations to remain intact. In the latter regard, the old valuation is reentered into the system with no change. Accordingly, with the acquisition of the status of the delay counter, the program progresses to decision block 438 which queries whether the status of the display delay counter is 0. An affirmative response indicates that no seven-second delay is underway, and this particular portion of the program is bypassed as represented by line 437. On the other hand, a negative response indicates that the system is in some form of a display condition within the seven-second delay interval. Accordingly, as represented at block 440, the display delay counter is decremented, such decrementation representing a one-second interval. The resultant value then is stored in RAM 368. Following this instruction, as represented at decision block 442, the display delay counter valuation again is examined for a 0 state representing the termination of a seven-second interval. In the event of a negative response representing that the system is still within the seven-second delay interval, then the program jumps, as before, to a more advanced level as represented, as noted above, at line 437.

In the event of an affirmative response at block 442, then an indication that the seven-second delay interval has expired is at hand, as represented at block 444, the value of a keypad flag is acquired. This flag, representing a bit in a general purpose register, indicates that at least one key has been depressed during the initial seven-second interval, the instant set condition representing the last such depression of a key. Upon acquiring the key depression status, then, as represented at decision block 446, an inquiry is made as to whether a number key has been depressed within seven seconds of the actuation of a function key. In the event of a negative response, no further action need be taken, and the program advances as represented by earlier described line 437. In the event the query at decision block 446 is in the affirmative, the program enters into two successive subroutines represented at blocks 448 and 450. Described later herein in detail, the subroutine at block 448 derives a temporary display mode wherein any key which is punched into the system will be displayed at display 292 in a sequence commencing as a digit on the far right which shifts position to the left with each new numerical key actuation. Additionally, it is necessary to blank out the keys not pertinent to the insertion. Further, the seven-second interval is restarted with each such numerical actuation. The subroutine represented at block 450 provides control for positioning the keypad data into a proper position within the display as represented above as well as into a proper RAM location.

Figure 8B:
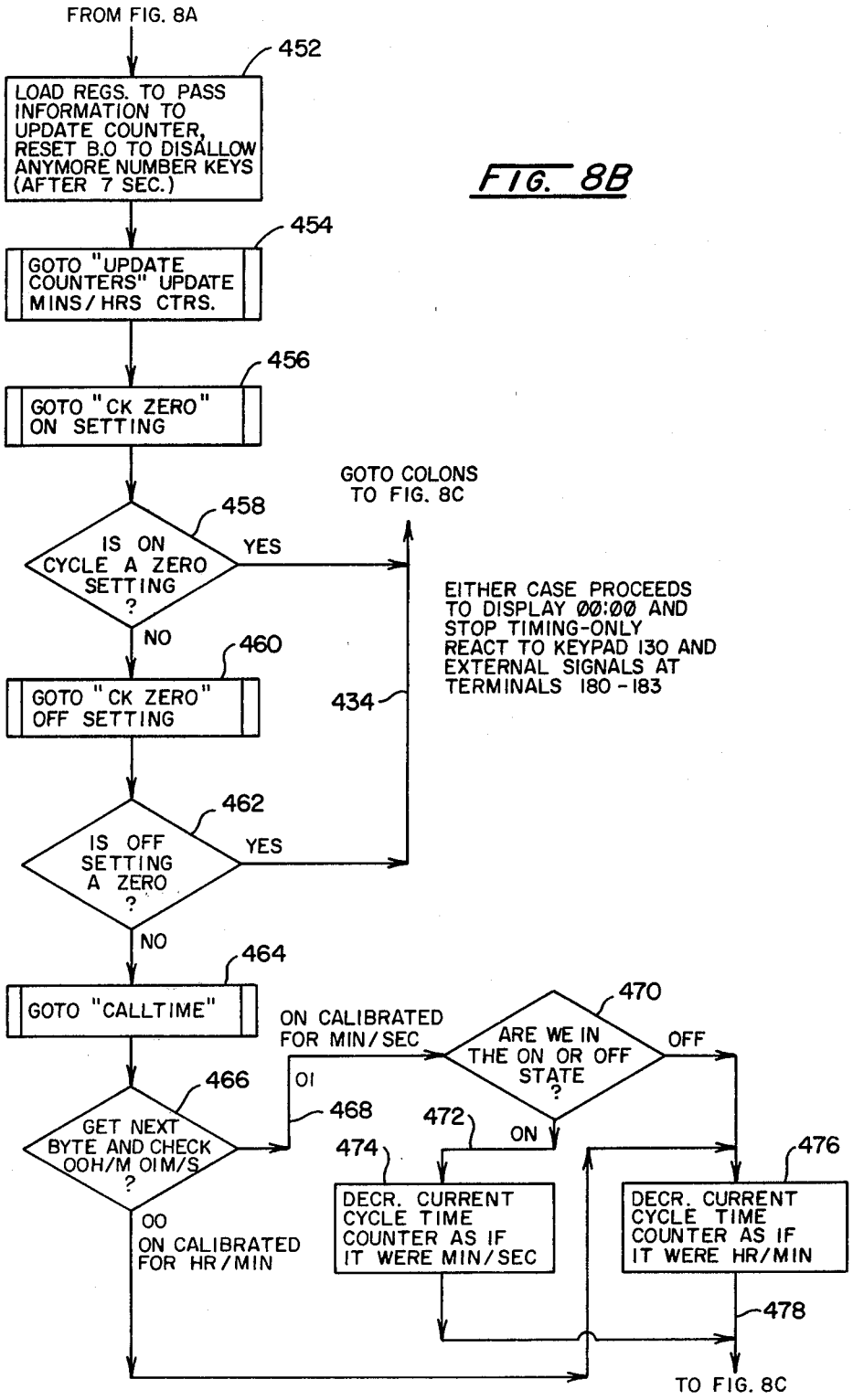

Looking to FIG. 8B, block 452 is shown as representing an instruction wherein random access memory 368 receives information at an appropriate location identifying those function keys which were pressed as well as the numerical data developed in conjunction therewith. Also, register B.0 is reset to ignore any numerical data occurring from number keys being pressed following a 7-second interval. Following the instruction at block 452, the program moves to the subroutine represented at block 454, which subroutine serves to update the counters representing minutes and hours. This subroutine is present inasmuch as it is entirely possible that one of these time increments will have taken place at this point within the program. Thus, the subroutine maintains track of time notwithstanding any condition of the output of display 292. Following the updating of all counters as represented by subroutine 454, the program then carries out another subroutine represented at block 456 wherein pertinent RAM locations are checked for the presence of a 0 setting. In the instant check zero subroutine, the 0 position for an "ON" setting is checked. The program then looks to block 458 to determine whether such a 0 level was inserted by the operator. In the event of an affirmative response, then, as represented by program line 434, the program proceeds to carry out logic controlling the energization of the colon within display 292 as well as to monitor for the actuation of function keys within keypad 130 or the receipt of externally derived signals at terminals 180-183. In the event of a negative response at block 458, then as represented at block 460, a next subroutine is carried out wherein the system is checked for the presence of a zero OFF setting. Following the acquisition of such information, as represented at block 462, a query is made as to whether the information received from subroutine 460 shows that the offsetting is 0. In the event of an affirmative response, again as represented at line 434, the program advances to the colon control, and monitors keypad 130 and terminals 180-183 as represented by the note. Also, display 292 will be caused to exhibit four 0s.

In the event of a negative response at block 462, the program proceeds to reiterate the CALLTIME subroutine as represented at block 464 and described earlier herein in connection with FIG. 9. The positioning of the subroutine at this location in the program is predicated upon the earlier requirement for generating necessary basic time increments at about each 120th machine cycle. The negative response at block 462 also represents an indication that neither the onsetting nor the offsetting is at a 0 valuation.

The program of CPU 150 provides an option for showing each of the ON and OFF settings in hours and minutes or, alternately, one such setting may be provided in terms of minutes and seconds. It may be recalled that in many injection well installations, it is desirable to control the injection of gas into the well by an ON setting calibrated to time-out in terms of minutes and seconds. This alternate arrangement is provided in the instant embodiment. Looking to decision block 466, an arrangement is provided wherein a bit within read only memory is set at a 00 value where both the on state and the off state are to be timed in terms of hours and minutes. Alternately, that bit will have a 01 orientation where it is desired to time the on state in terms of minutes and seconds. Thus, where the latter condition obtains, as represented at line 468, the program progresses to decision block 470 wherein the query as to whether the on or the off state is at hand is made. In the event that an on state is present, as represented at line 472, the program proceeds to the instruction of block 474 wherein the current cycle time counter is decremented at a rate representing a minutes and seconds timeout. From block 474, the program progresses, as represented at line 478, to the next general function of the program. However, in the event that the answer at block 470 shows that an off state is at hand, then the program is directed to block 476 wherein the current cycle time counter is decremented in terms of hours and minutes. Returning to decision block 466, in the event the read only memory is programmed to show the on time in terms of hours and minutes, then the program moves directly from decision block 466 to block 476 to provide for decrementation in terms of hours and minutes during an on cycle.

The program is shown extending from blocks 474 and 476 along line 478 to an update counter subroutine represented at block 480 in FIG. 8C. This subroutine is one which brings the appropriate counters up to date in the event that a principal time increment such as a second or minute has occurred at this juncture in the program. In the event that the current cycle time has reached a 0 valuation as represented by an affirmative response at decision block 482, then a condition will arise in which one or the other of the shuttle valve controlling solenoid windings 272 or 288 will require a pulse form of energization. Thus, the affirmative response at block 482 leads to a subroutine for carrying out such a pulsing or energization as represented at block 484. As will be described in detail later herein, this subroutine checks the current status of the controller to avoid pulsing the noted windings in the event that the proper state is at hand. Such situations can occur, for example, with the depression of the ON START or OFF START keys at keypad 130 in a redundant fashion wherein the desired cycle or state is already at hand. Note that the depression of a key representing an on cycle when the cycle currently is off will cause the controller to commence immediately an on cycle and vice versa.

A negative response at block 482 represents that the current time is not a 0 value and, as represented at line 486, the program proceeds to the initial instruction at block 488 of that portion of the program regulating the control of the colon of display 292 as through line 296. Note that line 434 from FIGS. 8A and 8B joins with line 486. As indicated earlier herein, the colon provides important status information in and of itself. During normal cycle or state timing, the colon is flashing at a readily discernible regular rate of about 2 cycles per second. However, when the operator pushes any of the display keys, the colon will assume a steady state condition to indicate that the settings themselves, as opposed to current time remaining within a cycle, are being displayed. Additionally, if an external signal is received through terminals 180-183, a steady state condition will obtain at the colon and this same condition will be present if a 0 setting occurs with respect to a cycle time in the appropriate on or off timing registers. Block 488 shows an instruction for obtaining the colon display information at hand from register B.0 and submitting it to an accumulator for examination. From block 488, the program progresses to decision block 490 at which position the query is made as to whether the colon is in a flashing condition. In the event that a flashing condition obtains, then the program progresses to block 492 at which point a bit in register B.0 set for a condition representing that the colon should flash at a frequency of two cycles per second. On the other hand, in the event that an indication that a non-flashing or steady state condition is at hand, as represented at block 494, the appropriate bit flag in register B.0 is set to show that the colon should be energized in a steady state fashion. This will be in accordance with a display information buffer contained within RAM 368 providing what the output condition of the system should be at any given time. In the event that any on or off state has been set by the operator at a 0 time, then all 0s will be displayed at display 292 notwithstanding the presence of an on or off state. Following the instructions at blocks 492 and 494, the program then progresses to block 496 which locates the position of commencement of the scan of keypad 130. As indicated earlier herein in conjunction with latch 168 (FIG. 7A), the four columns of keypad 130 are progressively powered up and for each such column power-up, the four corresponding rows are scanned. Accordingly, the keypad analysis initially looks to setting a loop counter to a value of 4, as represented at block 498. This counter serves to designate the column being powered up through latch 168. However, the first of the keypad columns is powered up at this time. The program then commences to output any pertinent results to the display as represented at block 500 as well as an output command to power up a next succeeding column. Following such power up, the noted column loop counter is decremented as represented at block 502.

Figure 8D:
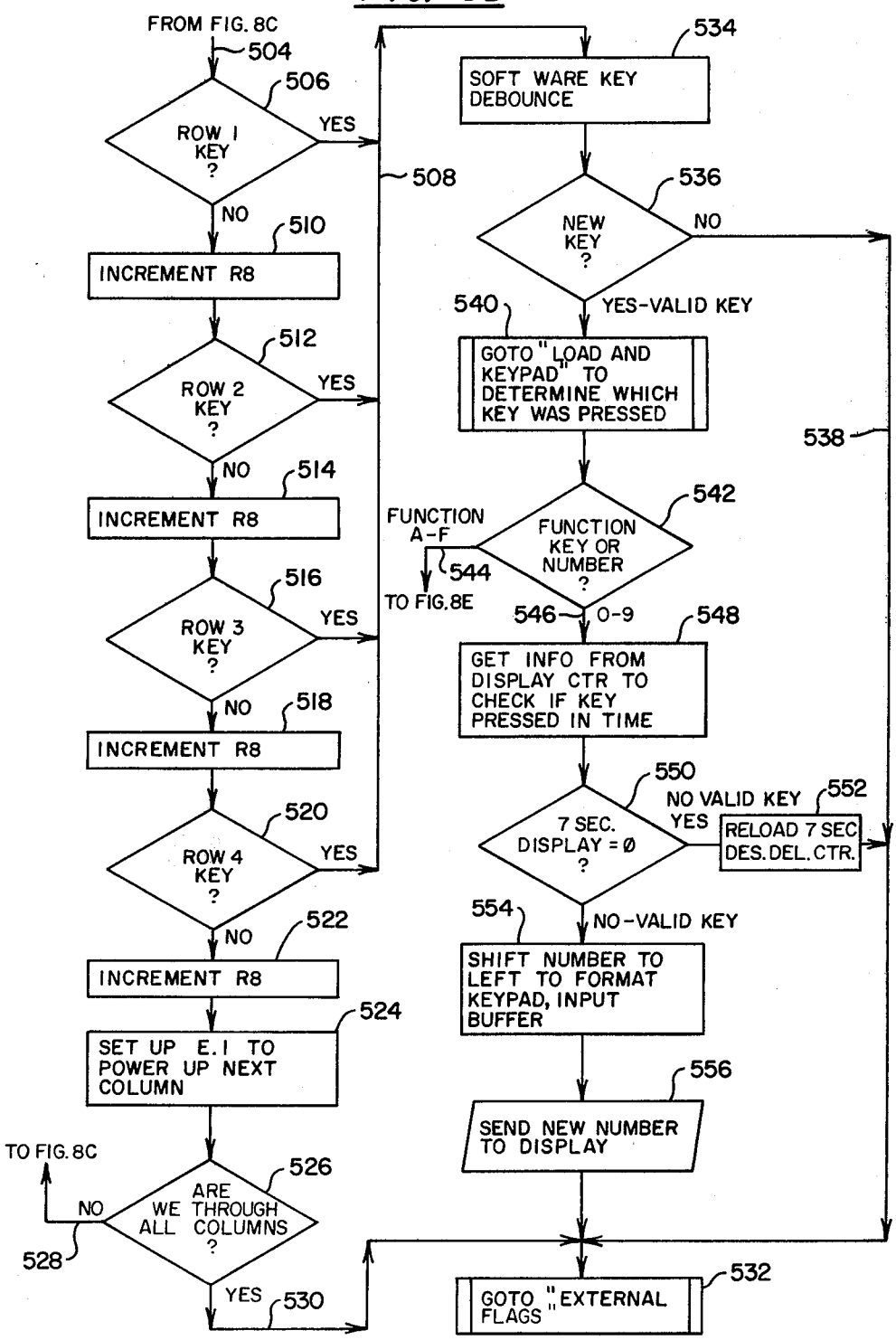

The output of block 502 is represented at line 504 which extends to FIG. 8D. Looking to the latter figure, line 504 is seen directed to decision block 506 representing a first of four, row scanning procedures. At block 506, the query is made as to whether a signal representing a key depression in conjunction with column and row 1 is in evidence. In the event of an affirmative response, the program is directed to line 508. A negative response provides for the program progressing to block 510 wherein a register R8 is incremented to indicate the row 1 status. From block 510, the program extends to next row decision block 512 wherein a determination is made as to whether a key has been depressed in row 2. An affirmative response leads the program to line 508, while a negative response leads to block 514 and the next incrementation of register R8. Similarly, from block 514 the program progresses to decision block 516 at which point the query is made as to whether a key has been depressed in row 3. An affirmative response leads to a signal at line 508, while a negative response leads to block 518 and the incrementation of register R8. Finally, the program progresses to decision block 520 for an analysis of row 4, a key being depressed in that row representing an affirmative response at line 508, while the lack of a key defining signal leads the program to block 522 and a fourth incrementation of register R8.

Following the scanning of rows for any given column, as represented at block 524, register E.0 is set up to provide for the powering up to the next succeeding column of the four available. From block 524, the program progresses to decision block 526 which queries as to whether all columns have been discretely powered up. In the event of a negative response, as represented at line 528, the keypad scanning instructions return to the input to block 500 (FIG. 8C) to carry out row scanning in connection with the next successive column. In the event all columns have been powered up, then as represented at line 530, the program progresses to a subroutine at block 532 wherein external flags, i.e., inputs to terminals 180-183 are investigated. This subroutine will be seen to ultimately return the program to start terminal 390.

In the event that an indication has been presented at line 508 that a key has been depressed, the program proceeds to block 534 wherein a determination is made as to whether a valid key depression is at hand. In this regard, any bounce characteristic is analyzed by carrying the key depression signal through a loop a given number of times, a continued appropriate signal representing a valid key depression. From block 534, the program progresses to decision block 536 at which position the query is made as to whether the key depressed represents a different key than that previously depressed. In the event of a negative response, the program progresses along line 538 to the external flag subroutine represented at block 532. Where a valid key depression is at hand, the affirmative response at block 536 leads to entry into a load and keypad subroutine represented at block 540. This LOAD & KEYPAD subroutine determines which key was pressed and is described in detail later herein. From block 540, the program then progresses to decision block 542 at which position a determination is made as to whether a function key (represented by hex A-F) or a numeric key (0-9) has been depressed. The former information represents an output at line 544, while the latter is represented at line 546. Because it is necessary in the logic of the system that a function key be depressed prior to the actuation of a number key, line 546 leads to the instructions of block 548 which commences the determination as to whether a number key has been properly actuated following the actuation of a function key. In this regard, following the acquisition of information from the display counter, the program progresses to decision block 550 which queries whether the number key has been pressed within the seven-second time envelope established with each depression of a function key. If the seven-second interval has expired, then as represented at block 552, an invalid key has been depressed, and the seven second display delay counter is reloaded. The program then progesses along line 538 to the EXTERNAL FLAGS subroutine as represented at block 532. In the event of a negative response at block 550, then a valid number key has been depressed and the program progresses to block 554 for instructions serving to cause the carrying out of appropriate scrolling wherein each new number entry is positioned at the right of the display, and those earlier presented entries are shifted to the left. This involves the formatting of a keypad input buffer located within RAM 368. The thus formatted information then is displayed at display 292 as represented by command block 556. From block 556, the program then enters into the EXTERNAL FLAGS monitoring subroutine represented at block 532.

Figure 8E:
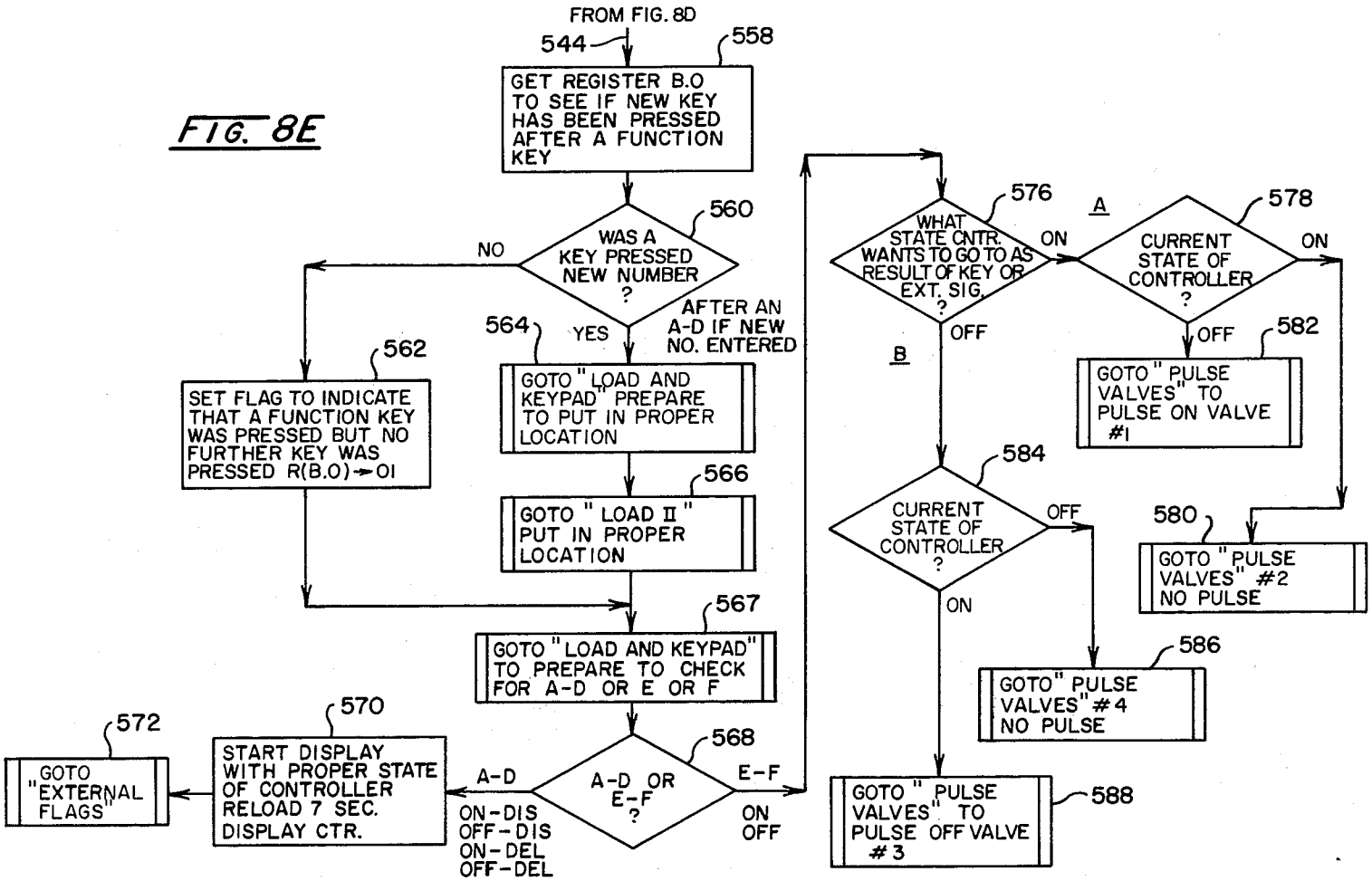

Returning to block 542 and output line 544, the function keys are represented in hexadecimal form as A-F and where the selection of a function key is indicated, the program progresses to block 558 in FIG. 8E. Block 558 contains instructions for acquiring the information within a register B.0, which information will identify which new key has been actuated.

The program then progresses to decision block 560 which queries whether a key representing a number was actuated following in sequence from an actuation of a function key A-D. This numerical key actuation must occur within the noted seven second interval. The A-D hexadecimal representations refer to the on and off delay keys as well as the display on and off keys. In the event of a negative response, then a condition obtains wherein one of the noted A-D function keys has been pressed but no number key actuation has occurred thereafter. In this event, as represented by block 562, a flag is set to indicate that a function key has been actuated but that no subsequent number key was pressed. Such activity is carried out in conjunction with register B.0. In the event of an affirmative response at block 560, then as represented at block 564, the subroutine LOAD & KEYPAD at block 564 is entered to provide appropriate preparation for the display entry of the new numerical data. From subroutine 564, the program progresses to the LOAD II subroutine as represented at block 566 for providing appropriate scrolling and the like in evoking a visual output at display 292 and positioning corresponding data in RAM. From block 566, the program progresses to block 567 to carry out logic determining whether a key within a particular grouping has been depressed.

From the subroutine represented by block 567, the program progresses to decision block 568 at which point the query is made as to whether the hexadecimal designated keys A-D or E-F have been actuated, the latter two designations representing the on and off keys. This separation of the function keys is required inasmuch as a display is associated with the display and delay keys, while a solenoid winding energization is involved in converting from an on to an off state. Further, the display and delay renumbering procedures require the disposition of new numerical data in RAM 368, while the on and off states do not require such manipulation of data.

In the event of an A-D selection at block 568, the program proceeds to block 570 wherein the display is commenced showing the time values as well as the on or off state of the controller. Additionally, a reloading of a seven second display counter is carried out. From block 570, the program progresses to the EXTERNAL FLAGS subroutine represented at block 572. This subroutine eventually will return the program to start terminal 390.

In the event of an E-F function key selection at block 568, as noted above, either an on or an off key has been depressed, and this key actuation may cause an immediate change of state at the option of the operator. Alternately, depression of these two keys provides a form of start or enter command wherein new cycle data in terms of time will commence to be operated upon. Accordingly, for this key selection, the program proceeds to decision block 576 wherein a query is made as to what state (on or off) the controller wishes to go to as a result of a key actuation or external signal input at a terminal 180-183. In the event the desire is to assume an on state, the program progresses to decision block 578 which determines the present state (on or off) of the controller. Where the current state is "on," then the program progresses to a PULSE VALVE subroutine represented at block 580. As described later herein, by entering this subroutine at a position designated No. 2, no pulse at a solenoid is derived, i.e., no solenoid winding is energized, and any new cycle time is entered into RAM. In the event that the query at block 578 indicates that the current state is "off," then as represented by block 582, the pulse valve subroutine again is entered into. However, its entry is at a position designated as No. 1, and a valve is actuated.

Returning to decision block 576, if the desired controller state is an "off" state, then as represented at decision block 584, the query is made as to what the current state of the controller is. In the event that such state is "off," then as represented at block 586, the pulse valve subroutine is entered, however, at position No. 4 and no valve winding is energized, i.e., pulsed. Where the answer at inquiry block 584 is that the current state is "on," then the program proceeds to the pulse valve subroutine represented at block 588 which is carried out at a location identified as No. 3 and wherein an appropriate solenoid winding is energized or pulsed to generate an "off" state. It may be recalled in connection with the above that the "on" solenoid winding has been identified at 274, while the corresponding "off" solenoid winding has been identified at 288 in FIG. 7B.

Figure 10A:
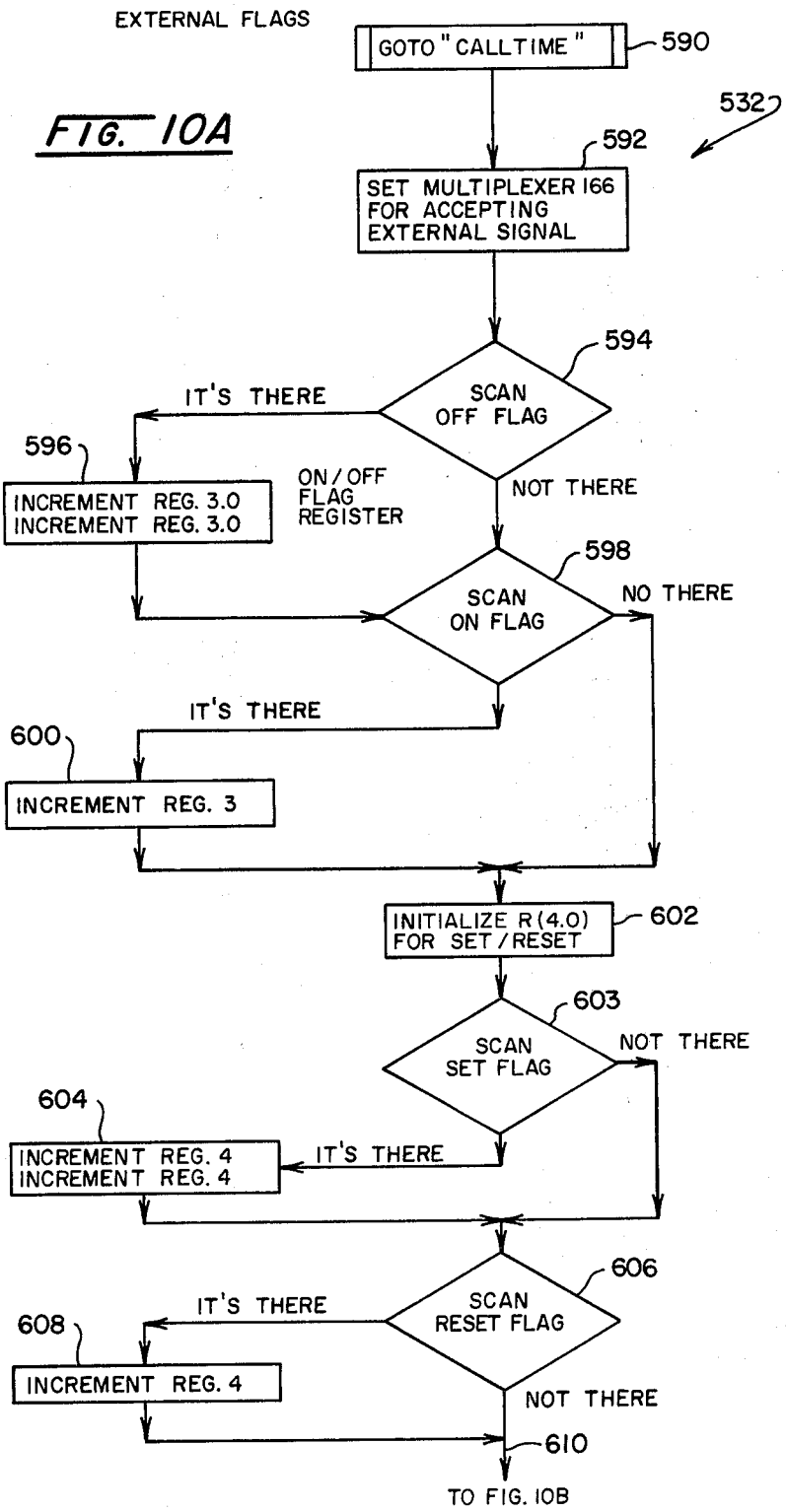

Turning now to the above-discussed subroutines, reference is made to FIGS. 10A–10D wherein the EXTERNAL FLAGS subroutine is set forth in flow diagrammatic fashion. This subroutine opens as represented at block 590 with a CALLTIME subroutine, approximately 120 machine cycles having occurred as this position is reached in the main program. Following the CALLTIME subroutine at block 590, the subroutine sets multiplexer 166 for receiving any external signals asserted at its A1-A4 input terminals. This procedure is represented at block 592. The subroutine then commences to scan the signal conditions asserted at terminals 180-183, represented herein as "flags." Thus, the "present" condition of the controller terminals is determined. Accordingly, as represented at decision block 594, the "OFF" flag is scanned and its presence, evolved by the presence of an active low at terminal 180, causes the incrementation of an internal register No. 3 twice to obtain an appropriate representation of such condition. This incrementation step is represented at block 596. Following such incrementation or in the absence of the "OFF" flag, the subroutine progresses to decision block 598 wherein the "ON" flag is scanned. Where such flag is present, representing an active low value at terminal 181, as represented at block 600, register 3 again is incremented. Following such incrementation, or where such flag is not present, the program initializes a register R (4.0) for receiving set/reset data as represented at block 602. Following such initialization, the program progresses to decision block 603 wherein the "SET" flag is scanned and in the presence of such flag as manifested by an active low value at terminal 182, register 4 is incremented twice as represented at block 604. Following such incrementation or where such "SET" flag is not present, the program then progresses to decision block 606 at which position the "RESET" flag is scanned and in the presence of such flag, representing an active low value at terminal 183, as is represented at terminal 608, register 4 is incremented. Following such incrementation or in the absence of the "RESET" flag, the program continues as represented by line 610 to the instructions of block 612 as represented in FIG. 10B. Looking to that figure, the instructions at this block provide for the acquisition of the previous state or condition of either "SET" or "RESET." As noted above, the program portion represented at FIG. 10A looks to determining the present state of external signals applied to terminals 180-183. In FIG. 10B, the program looks to the condition of controller memory as existing prior the above present state inputs. Further, this portion of the program determines whether any existing "SET" or "RESET" condition should be changed. The information derived at register 4.1 now is analyzed. At this juncture, it may be recalled that when a momentary "SET" external signal is received at terminal 182, the controller will remain in a "SET" condition ignoring all external signals until such time as a "RESET" signal is received. However, should a continuous external "SET" signal be received at terminal 182, no subsequent "RESET" signal will be recognized, the controller operating with respect to these external signals in a "FIRST IN" priority manner. The same logic obtains with the receipt of a corresponding momentary or continuous "RESET" signal at terminal 183. Following the acquisition of the previous state data, the program progresses to decision block 614 wherein the question as to whether such previous state was a "SET" or "RESET" condition. In the event the last preceding "SET" or "RESET" state was "SET" then the subroutine progresses to decision block 616 at which position the question as to whether the "present" state is a "SET" or "RESET" condition is made. In the event that the present state is a "SET" condition and inasmuch as the previous state was a "SET" condition, then as represented at block 618, the instant "SET" state is stored and as indicated at block 620 a display routine is carried out, particularly as it relates to the colon and dots or periods of display 292. In the event the present state is a "RESET" condition as determined at block 616, the subroutine progresses to block 621 where the inquiry is made as to whether any present state "SET" condition is gone. In the event that such "SET" state condition is present, in keeping with the "FIRST IN" priority discussed above, the program then proceeds to earlier described block 618 wherein the present state condition is stored, no requirement for checking EXTERNAL FLAGS further being present. In the event that the inquiry at block 621 is in the affirmative, then the subroutine progresses to block 622 where the present state register is loaded with a "RESET" flag.

Returning to decision block 614, where the previous state was a "RESET" condition, the subroutine progresses to block 624 wherein the query is made as to whether the present state is a "RESET" condition or a "SET" condition. In the event it is a "RESET" state, then as represented at block 626, the present state register is loaded with a "RESET" flag. Alternately, if the present state is a "SET" condition, the program proceeds to decision block 627 wherein the inquiry is made as to whether the present state "RESET" condition is gone. In the event of an affirmative response, an indication then is present that the earlier "RESET" state condition was manifested as a temporary or momentary external signal. Accordingly, the program then proceeds to block 628 wherein the present state register is loaded with a "SET" flag. In the event of a negative response at block 627, then the program follows the logic path as represented at line 629 to exit at line 630. Line 630 then carries information representing the currently updated "SET" or "RESET" condition of the controller. From line 630, the instant subroutine then proceeds to decision block 632 as shown in FIG. 10C. Looking to that figure, block 632 is shown to provide an inquiry as to what previous on or off state had occurred at the controller or whether no such state was at hand, a condition encountered, for example, during initial startup. In the event that an off state condition or lack of state represents the previous flag state of the controller, then as represented at block 634, a next inquiry is made to distinguish between the presence of an off state flag or no state condition at all. In the event that a previous "off" state obtains, then as represented at decision block 636, the present state is analyzed with respect to being "on," "off" or "nothing." If the present state is in an off condition, then as represented at block 638, that information is loaded into an accumulator and the system is examined for the presence of an inserted off time delay. As represented at decision block 639, where a delay is present but not timed out, then as represented at block 640, the subroutine progresses to the DISPLAY routine for purposes, for example, of causing the colon to be exhibited in steady state fashion. Where any delay has reached a 0 countdown or no delay is present, then, as represented at block 642, the principal or main program is reentered at a position identified as "B" and located in FIG. 8E intermediate blocks 576 and 584. Returning to decision block 634, where the previous state of the flags represents a "nothing" condition, then as represented at line 643, the program proceeds to the DISPLAY routine as noted above and discussed later herein in detail.

In the event the query at block 632 shows that the previous state of the flags was an on condition, then as represented at decision block 644, an analysis of the present state as to whether it is on, off or no such state exists, is made. In the event that an on state is the present state, then as represented at block 646, such information as to the present state is loaded into an appropriate accumulator, and a check is made for the presence or absence of an operator inserted time delay. As represented at decision block 648, a query then is made as to whether any delay has reached a 0 value, i.e., has timed out. In the event such time out has not been completed, then as represented at block 650, the DISPLAY subroutine is carried out wherein updated data and colon displays are made. In the event that a delay has terminated, as represented at block 652, the main program is reentered at a position identified as "A" shown in FIG. 8E intermediate block 576 and 578.

In the event that the query at block 644 shows that the previous state is "off" or "nothing," or if the inquiry at block 636 shows that a present state "on" or "nothing" condition obtains, then as represented by decision block 654, an inquiry is made as to whether the present state of the flags is "on," "off" or "nothing". In the event that the inquiry at block 654 reveals the present state of the flags to be either "on" or "off," then as represented at block 660, an inquiry is made to determine whether the present state of the flags is either "on" or "off." Where the present state is an "on" state, then as represented at block 662, the subroutine enters into a next subroutine identified as "LOAD II" and a register identified as "01" is maintained to represent an "on" flag status of flag, whereupon the subroutine then progresses to an appropriate colon display as represented at block 664. Where the inquiry at decision block 660 is that the present state is an off state, then as represented at block 666, the "LOAD II" subroutine is entered and a register identified as "02" is maintained for retaining an "OFF" flag status. From block 666, the DISPLAY routine as represented at block 664 is carried out. Where the inquiry at block 654 reveals a "nothing" present state of the flags, then as represented at line 656, the subroutine progresses to the DISPLAY routine at block 664.

Figures 11, 12, 13:
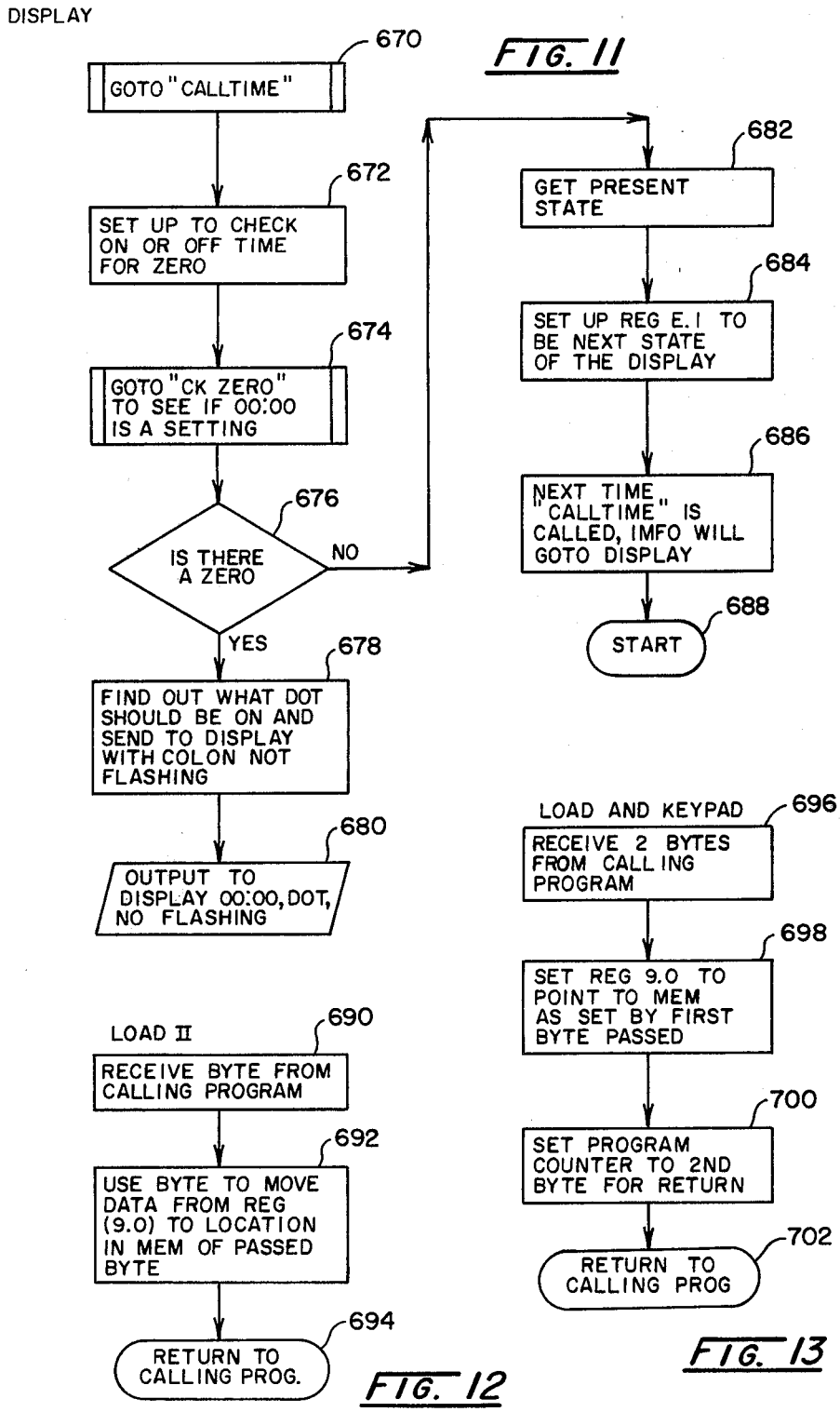
FIG. 11 is a flow diagram of the display routine of the microinstructions of the controller circuit of the invention.
FIG. 12 is a flow diagram of the LOAD II subroutine of the microinstructions of the control circuit of the invention.
FIG. 13 is a flow diagram of the LOAD & KEYPAD subroutine of the microinstructions of the controller circuit of the invention.

Turning to FIG. 11, this display subroutine as represented, for example, at blocks 620, 640, 650 and 664 is revealed in flow diagrammatic fashion. The DISPLAY subroutine is intended for controlling the dots identifying which state is at hand as well as the colon within display 292. It may be recalled that the colon assumes a steady state output condition in the presence of any received external signal or when either of the on or off settings has been given a 0 time increment as long as any time delay is not in effect after external signals (switch closures) arrive. As represented at block 670, the DISPLAY subroutine commences with a CALLTIME subroutine inasmuch as slightly fewer than 120 machine cycles will have occurred as this portion of the program is entered. This subroutine has been described above in connection with FIG. 9. Following the CALLTIME subroutine at block 670, the display subroutine acquires necessary data representing whether the on or off times have a 0 valuation. In conventional fashion, this involves the transferring of such information from internal registers or RAM 368 to an accumulator and the instruction is represented at block 672. From block 672, the subroutine progresses to block 674 at which point a "CHECK ZERO" subroutine is carried out to determine if the data acquired and connection with the program step at block 672 represent a 0 setting. Accordingly, as represented at decision block 676, where an indication is present that a 0 setting is at hand, then as represented at block 678, a determination is made as to which dot should be on to represent the state at hand, and this information is made available for outputting along with information providing for holding the colon in a steady state condition. Accordingly, as represented at block 680, appropriate outputs are made to display 292 to provide for a 00:00 display, an appropriate dot representation as to state and a steady state display of the colon.

Returning to decision block 676, in the event there is not a 0 detection for setting, then the subroutine progresses to acquire the present state of the controller as represented at block 682, whereupon as represented at block 684 a register identified as "E.1" is set up for showing the next state of the display. Following the preparation of register E.1, as represented at block 686, on the next occurrence of the CALLTIME subroutine, the information at register E.1 is submitted to display 292. Following such submission, as represented at terminal 688, the program returns to a start condition as represented at block 390 in FIG. 8A.

Referring to FIG. 12, the "LOAD II" subroutine is described. This is a utility subroutine which has been described, for example, at blocks 662 and 666 in FIG. 10C, block 566 in FIG. 8E, and block 450 in FIG. 8A. The utility subroutine is one required by the nature of operation of CPU 150 wherein for carrying out comparisons and the like, an 8-bit limitation in size of the compared values is at hand. Additionally, data in memory must be acquired and transferred to an accumulator for such purposes. Accordingly, as represented at block 690, a byte representing memory address is received from the calling program for purposes of accessing data from memory. Upon receiving such address information, the subroutine progresses to block 692 wherein the received byte is utilized to move data from a register 9.0 to that location in memory represented by the byte received at block 690. Following the instructions at block 692, the subroutine returns to the calling program as represented by terminal 694.

Referring to FIG. 13, the "LOAD & KEYPAD" subroutine is revealed in flow diagrammatic fashion. This subroutine serves to set up data for subsequent use, for example, by the LOAD II subroutine and has been described in connection with blocks 448 in FIG. 8A, 540 in FIG. 8D and 574 in FIG. 8E. The subroutine commences as represented at block 696 as receiving two bytes of information from the calling program. Generally, these two bytes contain data representing the first function key actuated in conjunction with changing a setting. For example, the four digits which may be used to change a setting for a given function key state are inserted within a seven second delay. Following this 7 second delay, those four digits must be passed to RAM 368 at locations which are designated by the function key. As represented at block 698, a register 9.0 is set in the subroutine to point to the appropriate memory location represented by the first of the bytes represented at block 696. Following block 698, as represented at block 700, the program counter is set to the second of the above noted bytes, whereupon, as represented at terminal 702, a return is made to the calling program, appropriate memory pointing procedures having taken place.

Figure 14:
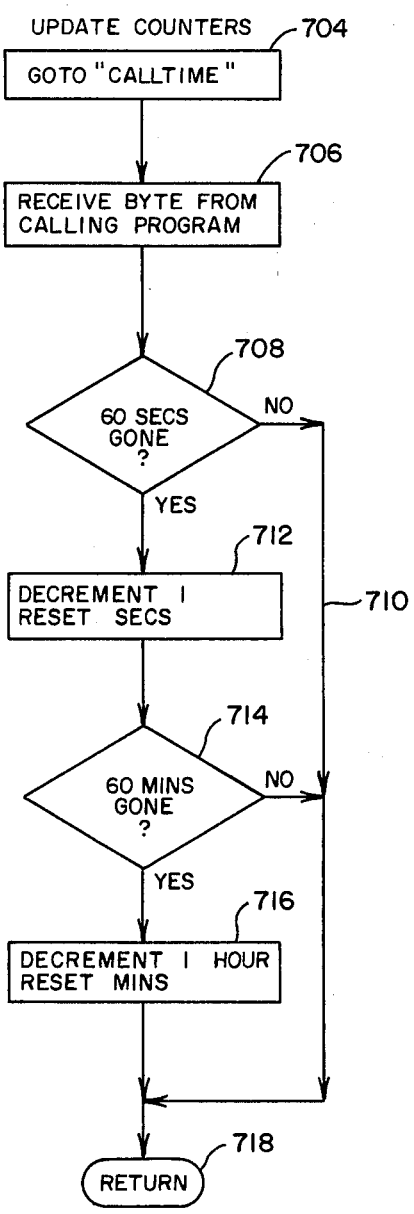
FIG. 14 is a flow diagram of the UPDATE COUNTERS subroutine of the microinstructions of the controller circuit of the invention.

Referring to FIG. 14, the "UPDATE COUNTERS" subroutine is revealed in flow diagrammatic fashion. An initial instruction in this subroutine is to carry out a CALLTIME subroutine as represented at block 704. As before, this subroutine will occur at approximately each 120th machine cycle. The UPDATE COUNTERS subroutine serves to update the minute and hour counters in correspondence with instructions from the main program. This subroutine has been described in conjunction with blocks 454 in FIG. 8B and 480 in FIG. 8C. As shown at block 706, a byte is received from the calling program to determine which counter is to be updated. Following the receipt of such information, as represented at decision block 708, a query is made as to whether 60 seconds have expired. In the event of a negative response, the subroutine returns to the main program as represented by line 710. In the event of an affirmative response at block 708, as represented at block 712, the minutes counter is decremented by one increment and the seconds counter is reset. Following the instructions at block 712, the subroutine progresses to decision block 714 wherein the query is made as to whether 60 minutes have passed. In the event of a negative response, the subroutine exists to the main program as represented at line 710, while an affirmative response leads to the instructions at block 716. The latter instructions provide for decrementing the hour counter while resetting the minutes counter. Following the instructions at block 16, the subroutine returns to the main program as represented by terminal 718.

Figure 15:
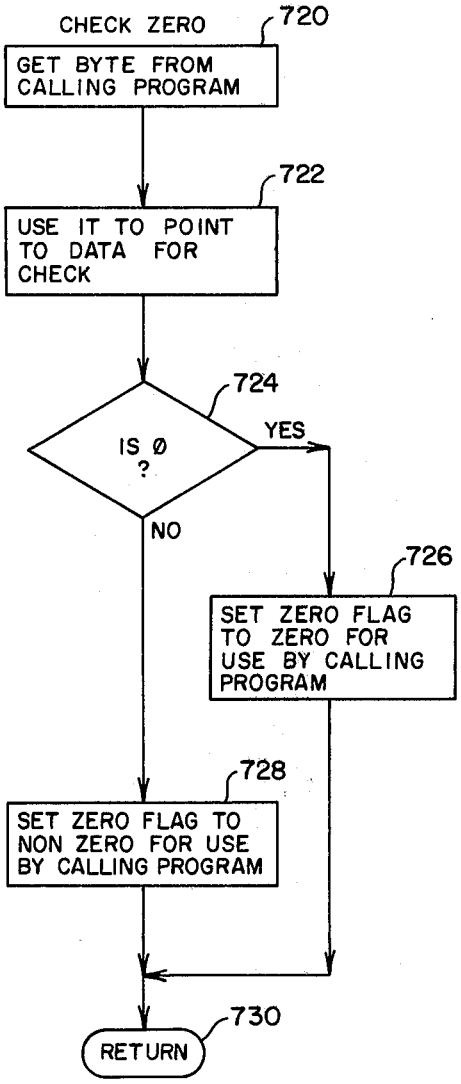
FIG. 15 is a flow diagram of the CHECK ZERO subroutine of the microinstructions of the controller circuit of the invention.

Referring to FIG. 15, the "CHECK ZERO" subroutine is described in block diagrammatic form. This subroutine has been described above in connection with block 456 in FIG. 8B and at block 674 in FIG. 11. The subroutine serves to determine whether any setting within the registers or memory has a 0 value and is called upon inasmuch as CPU 150 has a capability of check comparison at an 8-bit level, while certain of the settings require 16 bits. Looking to the diagram, the subroutine is shown to commence at block 720 wherein a byte representing an appropriate address is obtained from the calling main program. As represented at block 722, the subroutine then uses that data to find the appropriate memory or register location for carrying out a 0 check. Such 0 check is represented at decision block 724, the existence of a 0 at the check position leading to the instruction at block 726 wherein the 0 flag is set to an appropriate zero valuation for use by the calling program. In the event of an negative response at block 724, then as represented at block 728, the 0 flag is set to a non-zero valuation for use by the calling program. From either of block 726 or 728, as represented by terminal 730, the subroutine then returns to the main program.

Figure 16:
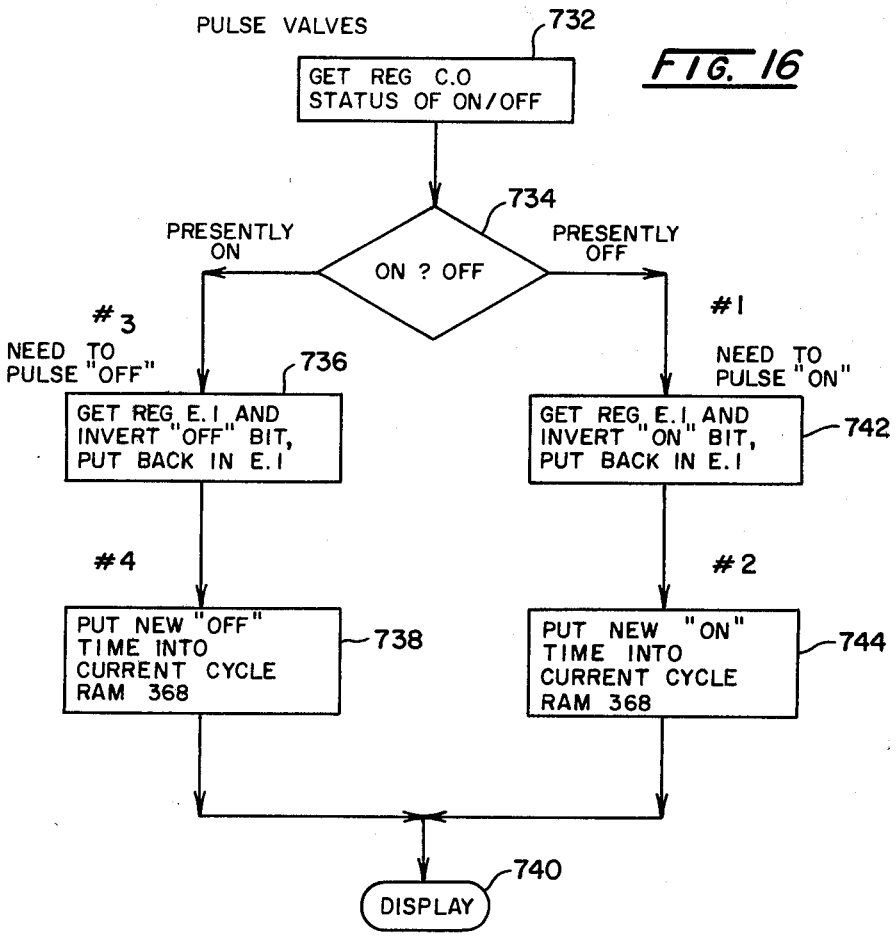
FIG. 16 is a flow diagram of the PULSE VALVES subroutine of the microinstructions of the controller circuit of the invention.

Referring to FIG. 16, the "PULSE VALVES" subroutine is revealed in block diagrammatic fashion. This subroutine has been referred to in conjunction with FIG. 8E and serves to set up a register designated E.1 which, in return, retains the information for controlling the inputs to latch 250 as described in conjunction with FIG. 7B. The current status of the controller with respect to on and off states is retained within register C.0 and this information initially is acquired by the instant subroutine as represented by block 732. With such acquisition, as represented at decision block 734, a query is made as to whether the current states are on or off. Where the response that the current state is on, then as represented at block 736, the register E.1 is acquired and the off bit is inverted and returned to that register. Note, additionally, that the number 3 is associated with block 736. This is the position within the instant PULSE VALVES subroutine to which the instruction at block 588 in FIG. 8E will enter. From block 736, the PULSE VALVES subroutine progresses to block 738 whereupon the instruction to insert any new off state time into RAM 368 is provided. Note, additionally, that an identification "#4" is positioned adjacent block 738. This represents the position of entry of instruction 586 described in conjunction with FIG. 8E. From block 738, the subroutine enters the DISPLAY routine described earlier in conjunction with FIG. 11 and represented at block 740.

In the event the query at block 734 indicates that an off state is at hand, then as represented at block 742, where a requirement for pulsing to an on state is at hand, register E.1 is acquired, the on bit is inverted and returned to the register. Note, additionally, that a number "1" is associated with the entry to block 742. This numerical indication has been represented in block 582 of FIG. 5E as showing the position of entry into the PULSE VALVES subroutine for that instruction.

Following the instruction of block 742, the subroutine progresses to the instructions of block 744 wherein the new time cycle data is inserted in RAM 368. As before, note the number "2" associated with block 744. This is the point of entry into the PULSE VALVES subroutine intended for the instruction of block 580 in FIG. 8E. Following the instructions represented at block 744, the subroutine enters the DISPLAY subroutine as represented at block 740.

Considering now the structural aspects of the housing of controller 60, it may be recalled that the controllers are called upon to operate in remote locales and under very severe environmental conditions. They are subjected to salt-moisture attack, as well as the dynamic forces of waves, temporary submersion and the like, when utilized in off-shore installations. Additionally, the inventor has determined that operational personnel cannot be relied upon to carry out such simple procedures as assuring that covers are closed and locked. Referring to FIGS. 4–6 and 17–18, the housing structure for controller 60 is revealed in detail. Recall that the structure includes a principal housing component 110 which supports a circuit housing 112, the latter being held in position by thumbscrew 114. Over this circuit housing there is positionable a front cover 116 which is sealed to the principal housing component 110 by an O-ring 114. The cover is latched by a latching component 136 operating in conjunction with a built up portion 134 of front cover 116. A clear polymeric window 118 is sealed within front cover 116 at the depressed region 132 thereof such that the operator can observe display 292 without opening the cover.

Figure 18:
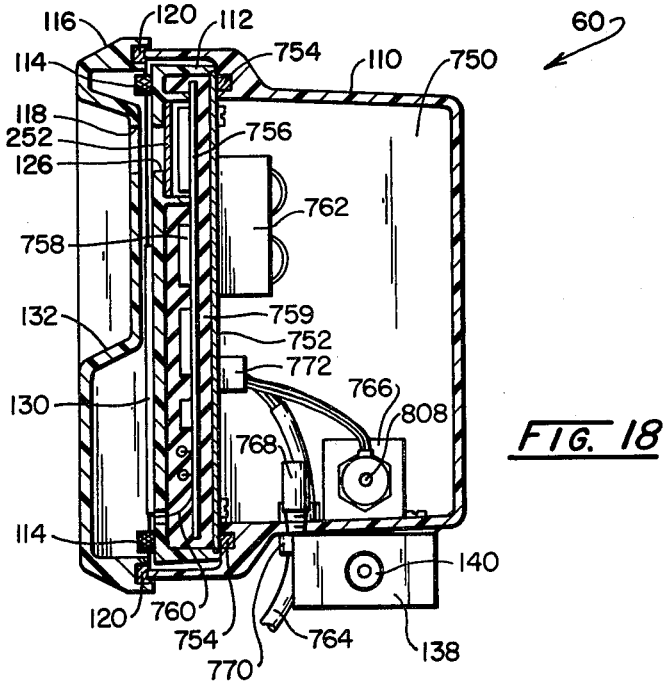
FIG. 18 is a sectional view of the controller of the invention taken through the plane 18—18 of FIG. 5.

Looking in particular to FIG. 18, the principal housing 110 is shown to be formed defining a rectangularly shaped cavity 750, the open face of which is covered by a rectangular metal backplate 752. Backplate 752 is dimensioned to provide for the covering of cavity 750 and forms the rearward face of circuit module 112. The latter housing 112 has a generally square configuration and nests against an O-ring 754 positioned within a correspondingly rectangular slot formed within a shoulder or ledge integrally fashioned within principal housing component 110. Recall that the housing 112 is held in position by thumbscrews 114 which serve to urge backplate 752 into sealing engagement with O-ring 754. The remainder of circuit housing 112 is formed of a fiber reinforced resin and cooperates with backplate 752 to define a cavity within which the singular circuit board 756 of controller 60 is positioned. All of the electrical components of the circuit, certain of which are represented, for example, at 758, are positioned upon this circuit board including liquid crystal display 252. Circuit board 756 is retained in position by screws (not shown) extending through the corners thereof into spacers integrally formed within housing 112. The circuit components 758 as well as circuit board 756 are further protected within housing 112 by virtue of a silicon rubber type material 759 which is inserted within the noted cavity of housing 112 by injection technique in the course of the fabrication thereof. This material may be present, for example, as Sylgard 170, marketed by Dow Corning Corp., Pittsburgh, Pa. and functions to protect fully all of the circuit components, board 756 and connectors from the external environment to which controller 60 may be subjected. To isolate display 252 from sealing material 759, a continuous wall is formed within housing 112 extending inwardly from a transparent window 126 within an opening formed in the circuit housing. This opening and window 126 is located to permit external viewing of the display. Preferably, a desiccant material also is positioned within the region defined by the continuous wall and display 252 to eliminate any moisture therewithin. The key input from keypad 130 to the circuit board is by a fully weather resistant multiple lead bus shown at 760 which is sealed by the noted silicon rubber material as it enters into the cavity of housing 112. Correspondingly, all of the keys within the very thin keypad 130 are sealed against the environment and the keypad is shown affixed to the fiberglass outward or operational surface of housing 112. Note that no switches of the conventional mechanical variety are present in the circuit and the association between the circuit components and switching function 130 is one which is fully sealed from the environment. With the arrangement shown, the circuit as well as components within cavity 750 are fully protected from the environment even though the operator may leave the front cover 116 open. The silicon rubber is retained in position by the cavity defined by the forward portion of module 112 and backplate 752. For factory maintenance of the circuit, this material is readily manually stripped from the circuit upon the disassembly of module 112 by removing backplate 752. Upon completion of the maintenance to the circuit, the cavity of the module again is filled with the protective material for reuse within controller 60.

Figure 17:
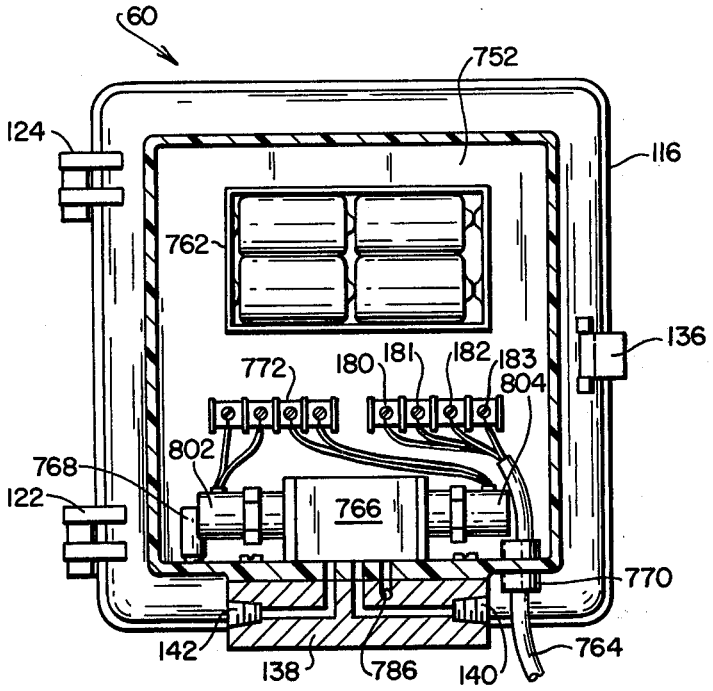
FIG. 17 is a sectional view of the controller of the invention taken through the plane 17—17 of FIG. 6.

Looking in particular to FIGS. 17 and 18, the components which are present within cavity 750 are revealed. These components include a battery power supply 762 mounted upon backplate 752; terminals 180–183 also mounted upon backplate 752; a solenoid actuated shuttle valve 766; a check valve 768 communicating between chamber 750 and the external environment; and a cable 764 extending from external switching through a seal 770 to appropriate electrical communication with terminals 180–183. Electrical leads extending from the circuit to the solenoids of valve 766 are shown coupled to appropriate terminals 772 coupled, in turn, to backplate 752. The Figures also show the positioning of manifold block 138 on the outside of principal housing component 110 and in communication with shuttle valve 766.

With the arrangement shown, note that the battery, terminals and shuttle valve are all enclosed within a protected cavity, which cavity remains protected even though front cover 116 may be left open. With the arrangement of the invention, the atmosphere within cavity 750 will be substantially comprised of non-corrosive natural gas in consequence of the cyclic operation of solenoid drive shuttle valve 766. In effect, a slight positive pressure further assuring the integrity of cavity 750 is built up in the course of operation of controller 60. This condition obtains in consequence of the operational structure of valve 766, this valve is described in detail and claimed in the noted U.S. Pat. No. 4,150,721. To show its use in developing the noted positive pressure within cavity 750, the valve 66 is shown in schematic sectional form in FIG. 19. Looking to that Figure, the components of valve 766 are shown in displaced fashion to permit a clear exposition of its operation. The Figure shows a main valve body 780 which includes a cylindrical valve bore 782 associated in gas transfer relationship with five conduits. In the latter regard, gas output conduit 784 extends through threaded connector 140 to be coupled with the diaphram of motor valve 34. Venting conduit 786 will be seen to vent the diaphram of the motor valve 34 to the atmosphere, this conduit also being shown in FIG. 17 extending through manifold 138. Gas input conduits 788 and 790 serve selectively to vent bore 782. A gas input conduit 792 extends from a gas distribution conduit present as an elongate bore 794 which, in turn, is associated through a conduit 796 to threaded bore connector bore 142. The latter connecting arrangement leads to an input of natural gas under pressure as described in FIG. 1 in connection with conduit 64 and filter 66. Bore 794 also communicates through two transversely disposed control outlets or conduits 798 and 800 with electromagnetically actuated solenoid valves shown respectively in schematic fashion at 802 and 804. Valves 802 and 804, in addition to communicating in gas transfer relationship with respective conduits 798 and 800, also communicate in venting relationship with venting conduits shown, respectively, at 806 and 808. These conduits output to cavity 750 to evolve the partial pressure and natural gas environment developed therein.

Slidably positioned within bore 782 is a shuttle piston 810 which, depending upon the vented status of either of conduits 788 or 790, assumes a terminal position serving either to direct pressurized gas from input 142 into conduit 796, or to vent the motor valve 34 diaphram through conduit 786. Shuttle 810 is formed having three spaced, O-ring carrying flanges 812, 814 and 816 which define, with bore 782, two adjacent gas flow regions.

The schematic representation of valves 802 and 804 reveals that each contains one of the earlier described inductive windings 274 and 288. The valves also each contain an associated poppet, respectively revealed at 820 and 822. Poppets 820 and 822, respectively, are biased such that they tend normally to close off respective conduits 798 and 800. Upon energization of an associated winding, the appropriate poppet 820 and 822 serves to block off a vent 806 or 808.

Figure 19:
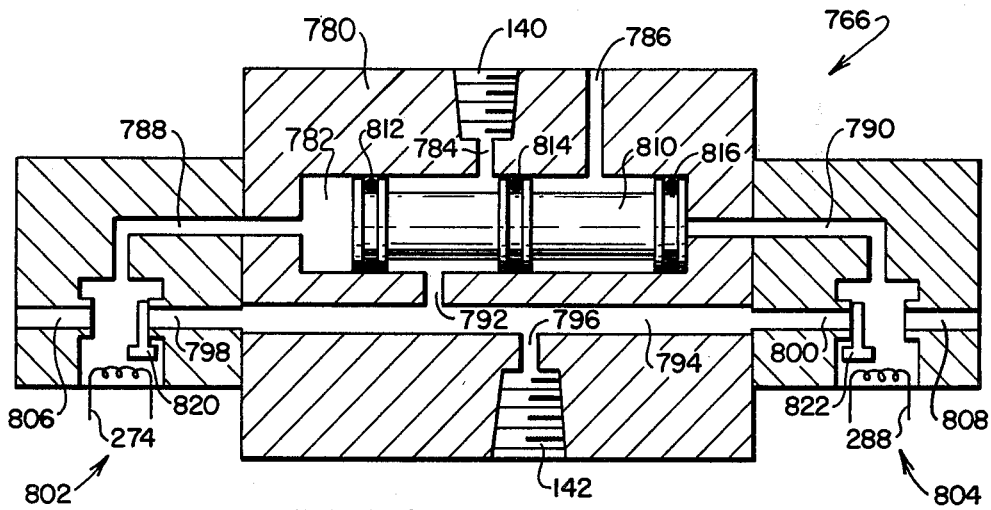
FIG. 19 is a sectional schematic view of a valve used in conjunction with the controller of the invention.

In the orientation as shown in FIG. 19, neither winding 274 nor winding 288 is energized and gas under pressure may enter through fitting 142, conduit 796 and pressurized bore 794. The pressurized gas then flows through conduit 792 and fitting 140 to pressurize the diaphram of motor valve 34. When winding 288 is energized or pulsed with current, for example for about ¼ second, poppet 822 seals conduit 800 and pressurized gas flows from bore 794 through conduits 800 and 790 to enter one end of bore 782 and drive shuttle 810 to a position abutting the outlet of conduit 788. As this happens, a small volume, i.e. a "puff" of natural gas is vented through conduit 806 to charge partially cavity 710 with natural gas. Accordingly, this measured, smaller amount of natural gas is utilized for partial pressurization of cavity 750 as opposed to the larger amounts which otherwise exit through conduit 786 from motor valve 34 to the atmosphere. In the noted orientation of shuttle 810, a gas flow circuit is presented permitting fitting 140 and conduit 784 to be in gas flow relationship with conduit 786 which is vented, as noted above, to the atmosphere. Accordingly, pressure is removed from the diaphram of motor valve 34. Subsequent energization of winding 274 of valve 802 caused conduit 806 to be closed thus to cause the pressurization of bore 782 from a path including conduit 788 for another pulsing interval. Shuttle 810 moves accordingly to the position shown in FIG. 19 and a "puff" of natural gas exits through conduit 808 to cavity 750.

The pulsed nature of the small puff of gas issuing from either of conduits or 808 serves another function within conduit 750. For example, check valve 768 preferably is present as a small, simple polymeric check valve of a variety commonly encountered in scuba masks. Through the puffing pressurization of cavity 750, such valve is actuated to expell any amount of fluid which may inadvertently have accumulated within the cavity in the course of operator attention thereto. Thus, cavity 750 is self-purging of any liquid accumulation and through its partial pressurization serves to prevent the ingress of any moisture through the seals leading thereto.

As indicated above, the instant controller contains a logic protocol which permits its universal utilization in a broad variety of well control situations. As one example, in certain plunger-lift gas well situations, it is desirable to utilize two motor valves and tubing circuits for the purpose first of unloading to a low pressure system and secondly, to supply gas to a high pressure sales line. The low pressure system may, for example, be present simply as a collecting tank required to collect a fluid slug from a well which is characterized in accumulating relatively large amounts of liquid. For this arrangement, two controllers are utilized, the first controlling a motor valve leading to the low pressure tank, and the second controlling a motor valve direction well output to a high pressure sales line. The first such controller may be arranged to respond to a low casing-tubing differential pressure to open the delivery line to the low pressure tank, thus to clear the fluid slug. Such an external "on" signal leading to the first controller also then may be utilized to assert a SET input to the second controller to turn off gas delivery to the high pressure sales line. As the plunger of the well reaches the top of the tubing string, a proximity detecting switch would then reset the second controller while turning off the first. This same form of arrangement may be utilized in conjunction with supplying relatively lower pressure gas to a plant or user facility during its demands, while permitting higher gas pressure valves to sell gas through a sales line system. The latter occurrence will take place, for example, on weekends and the like.

Since certain changes may be made in the above system and apparatus without departing from the scope of the invention herein involved, it is intended that all matter contained in the above description or shown in the accompanying drawings shall be interpreted as illustrative and not in a limiting sense.

I claim:

1. A controller for use in conjunction with the control of well installations of a variety wherein a control valve regulating the flow of fluid hydrocarbon is selectively actuated between an on state and an off state in response to corresponding control inputs thereto, comprising display means selectively energizable to provide visible digital characters representative of select components of time;

manual input means including an array of keys each being actuable to have a numeric output condition to represent a discrete one of a decade of numbers;

oscillator means energizable to provide a clock output of frequency selected to minimize the power requirement of said controller;

terminal means connectable with switches external to said controller for receiving an external signal therefrom;

detection means having an output of select duration in response to a received said external signal;

processor means including memory means for selectively retaining time interval data representing said numeric output conditions of said manual input means at addressable locations, said processor means being responsive to said clock output for carrying out time interval definition in correspondence with addressed said time interval data to derive actuation signals at the time limit of a said defined interval, responsive to said output of select duration for generating said actuation signals, and responsive to said clock output for deriving time increment outputs energizing said display means to show elasped time within a given said interval; and valve means responsive to said actuation signals to derive said control inputs.

2. The controller of claim 1 in which:

said manual input means includes function key means having on and off functions and actuable to provide corresponding on and off output conditions; and said processor means is responsive to said on and off output conditions for generating corresponding said actuation signals effecting said valve means responses respectively deriving said control inputs causing said control valve to be actuated to said on state and said off state.

3. The controller of claim 1 in which:

said manual input means includes display function key means manually actuable to provide on setting and off setting output conditions; and said processor means is responsive to a said numeric output condition for submittal of data corresponding therewith to said memory means only subsequent to a said setting output condition.

4. The controller of claim 3 in which said processor means is responsive to a said numeric output condition for submittal of data corresponding therewith to said memory means for a predetermined interval following said display function key means actuation.

5. The controller of claim 4 in which said predetermined interval is about seven seconds.

6. The controller of claim 1 in which:

said manual input means includes display function key means manually actuable to provide on setting and off setting output conditions; and said processor means is responsive to said on setting condition for addressing said memory means on setting to effect a display of digital characters at said display means corresponding to on setting time interval data and is responsive to said off setting condition for addressing said memory means to effect a display of digital characters at said display means corresponding to off setting interval data.

7. The controller of claim 1 in which:

said manual input means includes time interval function key means manually actuable to provide setting output conditions; and said processor means is responsive to a said setting output condition for addressing said memory means to effect a display of digital characters at said display means representing corresponding said time interval data.

8. The controller of claim 7 in which said processor means is responsive to a numeric output condition for submittal of data corresponding therewith to said memory means only subsequent to a said setting output condition.

9. The controller of claim 8 in which said processor means is responsive to a said numeric output condition for submittal of data corresponding therewith to said memory means for a predetermined interval following said time interval function key means actuation.

10. The controller of claim 1 in which said oscillator means clock output frequency is selected as less than about 300 KHz.

11. A controller for use in conjunction with the control of well installations of a variety wherein a control valve regulating the flow of fluid hydrocarbon is selectively actuated between an on state and an off state in response to corresponding control inputs thereto, comprising:

display means selectively energizable to provide visible digital characters representative of select components of time;

manual input means including an array of keys each being actuable to have a numeric output condition representing a discrete one of a decade of numbers and further including function designated key means actuable to provide a function output condition;

processor means including memory means for selectively retaining time interval data representing said numeric output conditions of said manual input means at addressable locations, said processor means including counter means for providing time interval definition in correspondence with addressed said time interval data to derive actuation signals at the timed limit of a said defined interval, for deriving time increment outputs energizing said display means to exhibit elapsed time within a given said interval, said processor means being responsive to said manual input means function output condition to energize said display means to display characters representing said memory means retained time interval data for a predetermined interval; and valve means responsive to said actuation signals to derive said control inputs.

12. The controller of claim 11 wherein said processor means is responsive to a first said numeric output condition for submittal of data corresponding therewith to said memory means only during said predetermined interval.

13. The controller of claim 12 wherein said processor means is responsive to a second numeric output condition only occurring during a next predetermined interval commencing with the occurrence of said response to said first numeric output condition.

14. The controller of claim 13 wherein said predetermined interval is about seven seconds in duration.

15. The controller of claim 11 wherein said processor means is responsive to a said first numeric output condition for submittal of data corresponding therewith to said memory means, and, simultaneously, for energizing said display means to effect a display of a digital character corresponding with said first numeric output condition only during said predetermined interval.

16. A controller for use in the control of well installations of a variety wherein a control valve regulating the flow of fluid hydrocarbon is selectively actuated between an on state and an off state in response to corresponding control inputs thereto, said installations including operational parameter monitoring switch means actuable to provide external signals, said controller comprising:

display means selectively energizable to provide visible digital characters representative of select components of time;

manual input means including an array of keys each being actuable to have a numeric output condition representing a discrete one of a decade of numbers and further including delay designated key means actuable to provide a delay output condition;

terminal means connectable for reception of said external signals;

processor means including memory means for selectively retaining time interval data representing said numeric output conditions of said manual input means at addressable locations, said processor means including counter means for providing time interval definition in accordance with addressed said time interval data to derive actuation signals at the timed limit of a said defined interval, said processor means being responsive to a said external signal at said terminal means to derive a said actuation signal following a selected delay interval; and valve means responsive to said actuation signals to derive said control inputs.

17. The controller of claim 16 wherein said processor means is responsive to a said manual input means delay output condition and at least one subsequently selected said numeric output condition for submittal of data corresponding therewith representing components of said selected delay interval to said memory means.

18. The controller of claim 17 wherein said processor means is responsive to said subsequently selected numeric output condition when provided within a predetermined interval commencing with the presentment of said delay output condition.

19. The controller of claim 16 wherein said processor means is responsive to a said manual input means delay output condition and at least one subsequently selected said numeric output condition for submittal of data corresponding therewith representing components of said selected delay interval to said memory means, and simultaneously energizing said display means to display at least one character representing said numeric output condition.

20. The controller of claim 16 wherein said processor means is responsive to a said manual input means delay output condition to energize said display means to display characters representing memory means retained data corresponding with said selected delay interval.

21. The controller of claim 20 wherein said processor means is responsive to a said manual input means delay output condition to effect said character display for a predetermined interval.

22. The controller of claim 21 wherein said predetermined interval is about seven seconds.

23. The controller of claim 16 wherein said processor means is responsive to a said manual input means delay output condition and at least one said numeric output condition representing a component of a selected delay interval when occurring within a predetermined interval commencing with the presentment of said delay output condition for submittal of data corresponding therewith to said memory means and for effecting the simultaneous energization of said display means to display at least one character repreesenting said numeric output condition.

24. The controller of claim 23 where said processor means is responsive to a said manual input means delay output condition to energize said display means to display characters representing memory means retained data corresponding with said selected delay interval.

25. The controller of claim 24 wherein said processor means is responsive to a said manual input means delay output condition to effect said character display for a predetermined interval.

26. A controller for use in the control of well installations wherein a control valve regulating the flow of fluid hydrocarbon is selectively actuated between on and off states in response to corresponding control inputs thereto and wherein operational parameter monitoring devices are actuable to provide external signals, comprising:

display means selectively energizable to provide visible outputs representative of select components of time;

manual input means selectively actuable to provide numeric output conditions each representing a number;

terminal means connectable for reception of said external signals as state change, set and reset inputs;

control circuit means responsive to said manual input means numeric output conditions for deriving actuation signals defining selectively timed said on and off states, and responsive to a said external signal received as a said state change input in the absence of a said external signal received as a set input for deriving a said actuation signal; and valve means responsive to said actuation signals to derive said control inputs.

27. The controller of claim 26 wherein said control circuit means is responsive to a said external signal received as a said state change input subsequent to the receipt of an external signal of limited duration received as a set input and receipt of an external signal received as a reset input subsequent to said set input reception.

28. The controller of claim 27 wherein:

said manual input means is selectively actuable to provide delay output conditions; and said control circuit means is responsive to a said external signal state change input and to a said delay output condition when occurring prior to said external signal for deriving a said actuating signal following a predetermined interval of time.

29. The controller of claim 28 in which said control circuit means is responsive to said delay output condition and subsequently asserted numeric output conditions for determining said predetermined interval of time.

30. The controller of claim 27 wherein said control circuit means is non-responsive to a said external signal received as a said state change input in the presence of a continuous external signal received as a continuous set input and is non-responsive to receipt of an external signal received as a reset input subsequent to the commencement of and in the presence of said continuous set input.

31. The controller of claim 27 wherein said control circuit means is responsive to a said external signal received as a said state change input in the presence of a continuous external signal received as a continuous reset input and is non-responsive to receipt of an external signal received as a set input subsequent to the commencement of and in the presence of said continuous reset input.

32. The controller of claim 31 wherein:

said manual input means is selectively actuable to provide delay output conditions; and said control circuit means is responsive to a said external signal state change input and to a said delay output condition when occurring prior to said external signal for deriving a said actuating signal following a predetermined interval of time.

33. The controller of claim 32 in which said control circuit means is responsive to said delay output condition and subsequently asserted numeric output conditions for determining said predetermined interval of time.

34. The controller of claim 26 in which said control circuit means comprises processor means including memory means for selectively retaining time interval data representing said numeric output conditions, said processor means including counter means for providing time interval definition in accordance with addressed said time interval data to derive said actuation signals at the timed limit of a said defined interval, responsive to a said set input to assume a set condition wherein said processor means is non-responsive to said state change inputs.

35. A controller for use in the control of well installations wherein a control valve regulating the flow of fluid hydrocarbon is selectively actuated between on and off states in response to corresponding control inputs thereto and wherein operational parameter monitoring devices are actuable to provide external signals, comprising:

display means selectively energizable to provide visible digital characters representative of select components of time;

manual input means selectively actuable to provide numeric output conditions, each representing a number and further actuable to provide a delay output condition;

terminal means connectable for reception of said external signals as state change inputs;

control circuit means responsive to said manual input means numeric output conditions for deriving actuation signals defining selectively timed said on and off states, responsive to a said delay output condition and a subsequently asserted said numeric output condition to define a select delay interval;

said control circuit means being responsive to a said external signal state change input and to a delay output condition when occurring prior to said external signal for deriving a said actuating signal following an interval of time corresponding with said select delay interval; and valve means responsive to said actuation signals to derive said control inputs.

36. The controller of claim 35 in which said control circuit means is responsive to said subsequently asserted numeric output condition only within a predetermined interval of time following the actuation of said manual input means to provide a delay output condition.

37. A controller for use in the control of well installations wherein a control valve regulating the flow of fluid hydrocarbon is selectively actuated between on and off states in response to corresponding control input thereto and wherein operational monitoring devices are actuable to provide external signals, comprising:

display means selectively energizable to provide visible digital characters representative of select components of time;

manual input means including an array of keys each being actuable to have a numeric output condition representing a discrete one of a decade of numbers;

terminal means connectable for reception of said external signals as state change, set and reset inputs;

processor means including memory means for selectively retaining time interval data representing said numeric output conditions of said manual input means, said processsor means including counter means for providing time interval definition in accordance with addressed said time interval data to derive said actuation signals at the timed limit of a said defined interval, responsive to a said external signal of limited duration received as a said set input to provide a set condition, and responsive to a said external signal received as a state change input only in the absence of said set condition for deriving a said actuation signal; and valve means responsive to said actuation signals to derive said control inputs.

38. The controller of claim 37 wherein said processor means is responsive to a said external signal received as a said reset input to extinguish said set condition when said set condition is provided as a result of said external signal of limited duration.

39. The controller of claim 38 wherein said processor means is responsive to a continuous said external signal received as a said set input to maintain said set condition in the presence of a said external signal subsequently received as a said reset input.

40. The controller of claim 39 wherein said processor means is responsive to a said external signal received as a said state change input in the presence of a continuous external signal received as a reset input and is non-responsive to receipt of an external signal received as a set input subsequent to the commencement of and in the presence of a said reset input.

41. The controller of claim 40 in which:

said manual input means includes delay designated key means actuable to provide a delay output condition; and said processor means is responsive to a said external signal received as a state change input in the presence of a said delay output condition for deriving a said actuating signal following a predetermined interval of time.

42. The controller of claim 41 wherein said processor means is responsive to a said manual input means delay output condition and at least one subsequently selected said numeric output condition for submittal of data corresponding therewith representing components of said selected delay interval to said memory means.

43. The controller of claim 42 wherein said processor means is responsive to said subsequently selected numeric output condition when provided within a predetermined interval commencing with the presentment of said delay output condition.

44. The controller of claim 41 wherein said processor means is responsive to a said manual input means delay output condition and at least one subsequently selected said numeric output condition for submittal of data corresponding therewith representing components of said selected delay interval to said memory means, and simultaneously energizing said display means to display at least one character representing said numeric output condition.

45. The controller of claim 41 wherein said processor means is responsive to a said manual input means delay output condition to energize said display means to display characters representing memory means retained data corresponding with said selected delay interval.

* * * * *